US005780209A

United States Patent [19]

Yamashita

[11] Patent Number: 5,780,209

[45] Date of Patent: Jul. 14, 1998

[54] PROCESSING OF PHOTOGRAPHIC SILVER HALIDE PHOTOSENSITIVE MATERIAL

[75] Inventor: Seiji Yamashita, Kanagawa, Japan

[73] Assignee: Fuji Photo Film Co., Ltd., Minami-ashigara, Japan

[21] Appl. No.: 887,129

[22] Filed: Jul. 2, 1997

[30] Foreign Application Priority Data

Sep. 6, 1996 [JP] Japan ..... 8-198401

[51] Int. Cl.[6] ..... G03C 5/31

[52] U.S. Cl. ..... 430/399; 430/139; 430/398; 430/440; 430/446; 430/963

[58] Field of Search ..... 430/139, 398, 430/399, 440, 446, 963

[56] References Cited

U.S. PATENT DOCUMENTS

| | | | |
|---|---|---|---|
| 5,474,879 | 12/1995 | Fitterman et al. | 430/487 |
| 5,498,511 | 3/1996 | Yamashita et al. | 430/399 |
| 5,565,308 | 10/1996 | Carli et al. | 430/963 |
| 5,580,706 | 12/1996 | Ishigaki | 430/963 |
| 5,652,088 | 7/1997 | Yamashita et al. | 430/139 |
| 5,665,530 | 9/1997 | Oyamada et al. | 430/139 |

FOREIGN PATENT DOCUMENTS

| | | |
|---|---|---|
| 128832 | 4/1992 | Japan . |
| 84343 | 3/1995 | Japan . |

*Primary Examiner*—Hoa Van Le

*Attorney, Agent, or Firm*—Burns, Doane, Swecker & Mathis, LLP

[57] ABSTRACT

A photographic silver halide photosensitive material comprising a silver halide emulsion of silver halide grains containing at least 20 mol % of AgCl, tabular grains having an aspect ratio of at least 2 accounting for at least 50% of the projected area of all silver halide grains, and having a Ag coverage of 0.5–1.5 g/m$^2$ and a gelatin coverage of 0.7–2.1 g/m$^2$ per one surface and a swelling factor of less than 180% is processed through an automatic processor by replenishing a developer containing an ascorbic acid type compound as a developing agent in an amount of 25–150 ml/m$^2$ and a fixer in an amount of 13–300 ml/m$^2$. The invention is successful in producing images of quality while reducing the amounts of replenishment and spent solutions, increasing processing stability, and eliminating silver sludging.

21 Claims, No Drawings

PROCESSING OF PHOTOGRAPHIC SILVER HALIDE PHOTOSENSITIVE MATERIAL

BACKGROUND OF THE INVENTION

This invention relates to a method for processing a photographic silver halide photosensitive material for medical radiographic imaging. More particularly, it relates to an image forming system comprising a photographic silver halide photosensitive material, processing solutions, screens and an automatic processor.

Since the Japanese governmental guidance tends toward the suppression of medical expense, many hospitals encounter the difficulty of management. Under the circumstances, the diagnostic radiographic imaging is utilized in a large quantity as compared with other diagnostic techniques and naturally occupies a greater proportion of the diagnostic expense.

For the processing of photographic silver halide photosensitive material for medical use, automatic processors are often used from the standpoint of quicker diagnosis and their use is now widespread partially because of an increase of emergency hospitals. As the use of automatic processors becomes widespread, the demand for rapid and enormous processing is increasing. Such a demand necessitates to increase the size of automatic processor. Nowadays, the automatic processor including accessories occupies a greater space in the floor area of a hospital. The cost of automatic processor is fairly high especially in urban hospitals and clinics which are located in high land-price and high rent areas. Since such a large size automatic processor is accompanied by spent solution tanks, pipes and ducts, the installation of the processor requires construction work for such accessories, which adds to the installation cost, pressing hard upon the hospital's management. The large quantity processing and the increased cost of spent solution disposal (associated with the ban of ocean dumping of spent solution enacted in 1996 and the start of land disposal) also press hard upon the hospital's management.

As automatic processors increase their capability, operators with specialized knowledge are needed for the maintenance and stable operation thereof. The labor cost of a specialized operator presses hard upon the hospital's management. Besides, the task of cleaning the developing tank of the stain by the silver dissolved out of the photosensitive material places a large weight on the daily maintenance and control of automatic processors.

Although inexpensive processors, processing solutions, and photosensitive materials are desirable, such advantages are often offset by a loss of diagnostic ability because there frequently occur instability of development processing, a drop of image quality, troubles as by failure, and a need for re-imaging.

JP-A 128832/1992 discloses a rapid processing technique using a photosensitive material with a less quantity of silver and a thin film gage.

In the processing of medical photosensitive materials, hydroquinones are commonly used as the developing agent. In a black-and-white developing solution using a hydroquinone as the developing agent, however, a sulfite must be added in a larger amount in order to increase the oxidation resistance of the solution. This causes a larger quantity of silver to be dissolved into the developer whereby the developer bath is contaminated black.

On the other hand, a developer system using an ascorbic acid compound as the developing agent is known. Development promoters for such a system are exemplified in U.S. Pat. No. 5,474,879. Also JP-A 84343/1995 discloses a technique using a developer containing ascorbic acid, a high luminance light emission screen, and a low sensitivity, low silver, low swell photosensitive material, thereby achieving a ultra-low replenishment and spent solution system.

However, the above-mentioned problem cannot be essentially overcome by a mere combination of these prior art techniques.

There is a desire to have a method capable of reducing the quantity of replenishment and spent solution to reduce the running cost, ensuring processing stability, reducing the cost of maintenance and control against silver sludging, and presenting high image quality.

SUMMARY OF THE INVENTION

An object of the invention is to provide a method for processing a photographic silver halide photosensitive material, which is capable of reducing the quantity of replenishment and spent solution to reduce the running cost, ensuring processing stability, reducing the cost of maintenance and control against silver sludging, and presenting high image quality.

Another object of the invention is to provide a method for processing a photographic silver halide photosensitive material, which is additionally capable of offering a satisfactory processing speed and processing throughput (processing quantity per unit time) and reducing the size of an automatic processor to reduce the installation space thereof.

A further object of the invention is to provide a method for processing a photographic silver halide photosensitive material, using an automatic processor which does not need pipes and ducts so that it can be installed at any place and the initial cost associated with the construction of accessories such as waste pipes is eliminated.

The present invention provides a method for processing after imagewise exposure a photographic silver halide photosensitive material for medical radiographic imaging in an automatic processor with processing solutions including a developer, a fixer, and washing water and/or stabilizer while replenishing the respective processing solutions. The photosensitive material comprises a silver halide emulsion of silver halide grains containing at least 20 mol % of silver chloride. At least 50% of the projected area of all the silver halide grains are tabular grains having an aspect ratio of at least 2. The photosensitive material has a silver coverage of less than 1.5 grams and a gelatin coverage of less than 2.1 grams per square meter of one surface thereof and a swelling factor of less than 180%. The developer contains an ascorbic acid type compound as a developing agent and is substantially free of a dihydroxybenzene. The developer is replenished in an amount of less than 150 ml per square meter of the photosensitive material and the fixer is replenished in an amount of less than 300 ml per square meter of the photosensitive material.

In one preferred embodiment, an overall processing time is less than 50 seconds. An hourly processing throughput is substantially more than 300 sheets of the quarter-size (10× 12 inches). A developing tank containing the developer and a fixing tank containing the fixer each have a liquid volume of less than 8.0 liters, a tank for washing water and/or stabilizer includes at least two stages, each stage having a liquid volume of less than 8.0 liters, the overall volume of spent solutions of the developer, the fixer and the washing water and/or stabilizer is less than 450 ml per square meter of the photosensitive material. After processing with the processing solutions, the photosensitive material is dried by means of a heat roller. The photosensitive material is capable of forming an image by combining it with a fluorescent screen having a maximum emission wavelength of longer than 500 nm or shorter than 350 nm, with crossover light being less than 20%. The fixer contains sodium thiosulfate as a fixing agent.

In a further preferred embodiment, continuous processing is possible in the substantial absence of pipes for the spent solutions of the developer and the fixer, pipes for replenishment and waste discharge of the washing water and/or stabilizer, and a stenchful vapor duct.

DESCRIPTION OF THE PREFERRED EMBODIMENTS

The method of the invention is to process a photographic silver halide photosensitive material for medical radiographic imaging after imagewise exposure in an automatic processor.

The photographic silver halide photosensitive material used herein comprises a silver halide emulsion of silver halide grains containing at least 20 mol % of silver chloride. Tabular grains having an aspect ratio of at least 2 account for at least 50% of the projected area of all the silver halide grains. The photosensitive material has a silver coverage of less than 1.5 grams and a gelatin coverage of less than 2.1 grams, both per square meter of one surface thereof. The photosensitive material has a swelling factor of less than 180%.

The developer used herein contains an ascorbic acid type compound (including ascorbic acid and derivatives thereof) as a developing agent. The developer is replenished in an amount of less than 150 ml per square meter of the photosensitive material while the fixer is replenished in an amount of less than 300 ml per square meter of the photosensitive material.

Insofar as these requirements are met, the present invention offers advantages including the reduced quantity of replenishment and spent solution, processing stability, the ease of maintenance and control of the automatic processor, and high image quality. Since the processing system uses an ascorbic acid type developing agent imposing minimal pollution load and causing minimal silver sludging and is designed for low replenishment, the system ensures stable processing of the above-defined photosensitive material to produce images of quality.

If the AgCl content of silver halide is less than 20 mol %, the running process results in a low sensitivity and poor fixation. High sensitivity is lost if the proportion of tabular grains is less than 50%. If the silver coverage is more than 1.5 g/m$^2$, the running process results in a low sensitivity and poor fixation. If the gelatin coverage is more than 2.1 g/m$^2$ or if the swelling factor is more than 180%, the running process results in a low sensitivity and inefficient drying.

The advantages of the invention are obtained when all the above-mentioned requirements are met, but lost when one or more of the requirements are lacking.

In one preferred embodiment of the invention, an overall processing time is less than 50 seconds, an hourly processing throughput is substantially more than 300 sheets of the quarter-size (10×12 inches=774 cm$^2$), and at the end of processing, the photosensitive material is dried by means of a heat roller. Such improvements in processing speed and capacity enables rapid, large quantity processing.

Also from the standpoint of achieving an increased processing speed and capacity to reduce the size of the processor, it is preferred that a developing tank containing the developer has a total liquid volume of less than 8.0 liters, and a fixing tank containing the fixer has a total liquid volume of less than 8.0 liters, and each stage of washing water and/or stabilizer bath has a liquid volume of less than 8.0 liters. For further reducing the replenishment and the quantity of spent solution, the water washing bath and/or stabilizing bath should preferably have two or more stages to increase the efficiency of processing. Preferably, the overall volume of spent solutions of the developer, the fixer and the washing water and/or stabilizer is less than 450 ml/m$^2$ of the photosensitive material.

From the standpoint of further suppressing silver sludging, sodium thiosulfate (known as hypo) is used as a fixing agent.

The automatic processor can be reduced in size and pipes and ducts can be eliminated therefrom. This increases the freedom of choice of the area where the processor is installed, reducing the cost of installation.

Preferably the photosensitive material of the invention is capable of forming an image by combining it with a fluorescent screen having a maximum emission wavelength of longer than 500 nm or shorter than 350 nm, with less than 20% of crossover light. This ensures to produce images of increased sharpness and quality.

Now the components of the present invention are described in detail.

The photographic silver halide photosensitive material used herein employs a silver halide emulsion of silver halide grains containing at least 20 mol % of silver chloride. Tabular grains having an aspect ratio of at least 2 account for at least 50% of the projected area of all the silver halide grains. Emulsions of tabular silver chloride, silver chlorobromide, silver chloroiodobromide and silver chloroiodide grains are preferred. Especially preferred emulsions are described below.

In a silver halide emulsion containing silver halide grains in a dispersing medium, tabular grains whose major planes are {100} or {111} faces and which have an aspect ratio of at least 2 account for at least 50%, preferably 60 to 100%, more preferably 70 to 100% of the overall projected area of the silver halide grains. The tabular grains designate grains having an aspect ratio (diameter/thickness) of greater than 1. The major plane designates the maximum outer surface of a tabular grain. Such tabular grains preferably have a thickness of less than 0.35 μm, more preferably 0.05 to 0.3 μm, most preferably 0.05 to 0.25 μm. The aspect ratio is at least 2, preferably from 3 to 30, more preferably from 5 to 20. The diameter is the diameter of a circle having an equal area to the projected area of a tabular grain, and the thickness is the distance between two major planes. The content of silver chloride, that is, $Cl^-$ content is more than 20 mol %, preferably 30 to 100 mol %, more preferably 40 to 100 mol %, most preferably 50 to 100 mol %.

In the practice of the invention, any of nucleation techniques may be used as described in JP-B 8326/1989, 8325/1989, 8324/1989, 14328/1991, 81782/1992, 40298/1993, 39459/1993, and 12696/1993, JP-A 250943/1989, 213836/1988, 218938/1989, 281149/1989, 218959/1987, 204073/1993, 88017/1976, and 24238/1988, and Japanese Patent Application No. 264059/1993.

Described below is the method of growing crystals by physical ripening in the presence of silver halide fine grains wherein the fine grains dissolve away and substrate grains grow.

In the fine grain emulsion addition method, an AgX fine grain emulsion having a particle size of less than 0.15 μm, preferably less than 0.1 μm, more preferably 0.06 to 0.006 μm is added to a reaction vessel whereupon tabular grains grow by Ostwald ripening. The fine grain emulsion may be added either continuously or discontinuously. The fine grain emulsion can be continuously prepared by feeding a $AgNO_3$ solution and a $X^-$ salt solution into a mixer disposed in proximity to the reaction vessel whereupon the emulsion is continuously added to the reaction vessel immediately thereafter. Alternatively, the fine grain emulsion can be prepared batchwise in a separate vessel and added either continuously or discontinuously. The fine grain emulsion may be added either in liquid form or as dry powder. It is also possible to add dry powder in liquid form by mixing it with water immediately before addition. Fine grains are preferably added such that the fine grains disappear within 20 minutes, more preferably within 10 seconds to 10 minutes. If the disappearing time is longer, undesirable ripening can occur between fine grains to increase the grain size. Therefore, it is preferred that the entire amount is not added simultaneously. Preferably the fine grains are substantially free of multiple twin crystal grains. The multiple twin crystal grains used herein designate grains having at least two twin planes per grain. The term "substantially free" means that the number proportion of multiple twin crystal grains is less than 5%, preferably less than 1%, more preferably less than 0.1%. More preferably the fine grains are also substantially free of singlet twin crystal grains. Further preferably the fine grains are substantially free of spiral rearrangement. The term "substantially free" used herein is as defined above.

Such fine grains have a halogen composition of AgCl, AgBr, AgBrI (preferably having a $I^-$ content of less than 10 mol %, more preferably less than 5 mol %) and mixed crystals of two or more. For the remaining detail, reference should be made to Japanese Patent Application No. 214109/1992.

The total amount of fine grains added should be more than 20 mol %, preferably more than 40 mol %, more preferably 50 to 98 mol % of the overall silver halide amount.

The fine grains preferably have a Cl content of more than 10 mol %, more preferably 50 to 100 mol %.

Upon nucleation, ripening and growth, the dispersing medium used may be a conventional well-known dispersing medium for AgX emulsions. It is preferred to use gelatin having a methionine content of 0 to 50 μmol/g, more preferably 0 to 30 μmol/g. The use of gelatin upon ripening and growth is preferred because thinner tabular grains having a narrow diameter size distribution are formed. The preferred dispersing medium which can be used herein includes the synthetic polymers described in JP-B 16365/1977, Journal of Japanese Photographic Society, Vol. 29 (1), 17, 22 (1966), ibid., Vol. 30 (1), 10, 19 (1967), ibid., Vol. 30 (2), 17 (1967), ibid., Vol. 33 (3), 24 (1967). Upon growth by fine grain addition, the pH should be at least 2.0, preferably 3 to 10, more preferably 4 to 9.

Also, the pCl should be at least 1.0, preferably at least 1.6, more preferably 2.0 to 3.0. It is noted that pCl is defined as $$pCl = -\log [Cl^-]$$

wherein $[Cl^-]$ is the activity of Cl ion in the solution. Reference should be made to T. H. James, The Theory of The Photographic Process, 4th Ed., Ch. 1.

Such growth conditions are preferred especially when tabular grains having {100} crystal faces as the major planes are grown.

If the pH is lower than 2.0, in the case of tabular grains having {100} faces as the major planes, for example, the lateral growth is restrained to lower the aspect ratio, and the emulsion tends to lower the covering power and sensitivity. Above pH 2.0, the lateral growth rate becomes higher, and an emulsion having a high aspect ratio and covering power is obtained although the emulsion tends to have high fog and low sensitivity.

If the pCl is lower than 1.0, the vertical growth is promoted to lower the aspect ratio, and the emulsion tends to lower the covering power and sensitivity. If the pCl exceeds 1.6, the aspect ratio becomes higher and the covering power increases although the emulsion tends to have high fog and low sensitivity. If silver halide fine grains help substrate grains grow at this point, there result low fog, high sensitivity, high aspect ratio and high covering power even above pH 6 and/or pCl 1.6.

With respect to the monodispersity of the emulsion according to the invention, the monodispersity is preferably less than 30%, more preferably 5 to 25% when expressed by a coefficient of variation as defined by the method described in JP-A 745481/1984. Especially when the emulsion is used in high contrast photosensitive material, a coefficient of variation of 5 to 15% is preferred.

Further, the silver chloride tabular emulsion which is preferred in the present invention has the following characteristics.

It is preferred that the nucleus of the grain contain one corner and be present in a square region of 0.001 to 10%, more preferably 0.001 to 7% of the total projected area. The corner of a tabular grain designates the intersection between side surfaces of a {100} plate. Then a tabular grain generally has four corners.

The nuclear portion of a tabular grain designates a portion of a grain free of anisotropic growth which is triggered by a halogen gap by hetero halogen and/or an impurity to first acquire anisotropic growth. Anisotropic growth is often conferred by introduction of a transition, etc. into the grain. The location of a nucleus is often acknowledged by a direct low-temperature transmission electron microscope photographic image (referred to as "direct TEM image," hereinafter) where a lattice strain is observed. It does not matter that a lattice strain of a nuclear portion is not observed in a direct TEM image, if the location of a nucleus can be indirectly observed by introducing a history in growth by a method of adding a hetero halogen such as $I^-$ and/or $Br^-$ in an amount of 0.01 to 5 mol %, more preferably 0.05 to 3 mol %, most preferably 0.1 to 1 mol % based on the amount of silver added and observing a direct TEM image or low-temperature light emission in the case of $I^-$ (reference is made to, for example, Journal of Imaging Science, Vol. 31, 15–26 (1987)). The nucleus of the grain according to the invention often has a different composition from the remaining portion (other than the nucleus) though the composition need not necessarily be different. In this case, however, the location of a nucleus must be acknowledged as by introducing a growth history into the nucleus.

The tabular grains preferably have two transition lines extending from the nucleus in a direct TEM image when observed from a direction perpendicular to the major plane. The transition lines are preferably maintained until the projected area of growing tabular grains reaches 20%, more preferably 50%, most preferably 99% of the projected area of completed grains. Also, the transition lines often extend directly from the nucleus upon nucleation. Those grains in which the extending transition lines partially disappear fall within the scope of the invention if an extension of the transition line reaches the nucleus upon nucleation.

Characteristically, the angle between the transition lines is in the range of 5° to 85°, preferably 30° to 75°, more preferably 45° to 75° when observed from a direction perpendicular to the major plane. Also characteristically, the transition lines are often introduced in (31n) direction provided that the side surface of a tabular grain is {100}.

To form grains of such structure, it is preferred that the transition lines introduced by nucleation do not disappear. For {100} tabular grains, it is observed that the transition lines introduced by nucleation disappear during grain formation, for example, physical ripening and grain growth, resulting in thicker grains. Then, ripening must be conducted in the presence of fine grains, for example, so that the disappearance of transition lines by dissolving out of the corners of tabular grains may not occur. Growth must be initiated from the state where the transition lines are still left. Further, in order that the transition lines be stable, once introduced transition lines must be pinned. To this end, use may be made of a method of conducting growth from a mixed halogen composition preferably containing 0.1 to 25 mol %, more preferably 0.5 to 10 mol %, most preferably 0.7 to 7 mol % of a hetero halogen rather than a single halogen composition, a method of conducting growth from a halogen solution of a single halogen composition preferably containing 0.1 to 20 mol %, more preferably 0.2 to 10 mol % of an impurity such as potassium ferrocyanide, and a method of lowering the growing temperature, preferably growing at a temperature of 30° to 75° C., more preferably 35° to 65° C., so as to prevent cancellation of the pinning of transition lines. Any one of these methods may be used while two or more methods may be combined. In order to conduct growth while maintaining anisotropic growth, a $Ag^+$ salt solution and a $X^-$ salt solution may be added in low supersaturation.

One exemplary direct TEM technique is described below.

1. Sample preparation

After an emulsion during and/or after grain formation is added to a methanol solution of phenyl mercaptotetrazole ($1\times10^{-3}$ to $1\times10^{-2}$ mol/mol of Ag) so as not to incur grain deformation, the grains are taken out by centrifugation. The grains are added dropwise onto an electron microscope observing sample holder (mesh) having a carbon support film previously attached thereto and dried, obtaining a sample.

2. Grain observation

Using an electron microscope JEM-2000FXII by Nihon Denshi K. K. and a sample cooling holder 626-0300 Cryostation by Gatan Co., the thus prepared sample is observed at an accelerating voltage of 200 kV, a magnification of 5,000 to 50,000, and a temperature of −120° C. With respect to grains in which no transition lines are observed, an observation is made again, with the sample inclined, to acknowledge the presence or absence of transition.

Most of the transition lines are observed to extend from the nucleus to the edge. For some transition lines, only a part thereof is observed. This is also included in the emulsion of the invention.

The nucleation of tabular grains according to the invention can be initiated when a transition is introduced into grains by a halogen gap or impurity. If the number of transitions introduced into a grain is more than three, then there is finally obtained a thick grain which is growth promoted in x, y and z axis directions and has a low aspect ratio. Herein, x and y axes are parallel to the major plane and orthogonal to each other while z axis is perpendicular to the major plane. Accordingly, the quantity of transition formation is controlled so as to reduce the frequency of thick grain formation and increase the frequency of tabular grain formation. For the purpose of controlling the quantity of transition formation, the type and amount of a halogen or the type and amount of an impurity to trigger a transition are determined by a trial-and-error experimentation. Also the addition of halogen used for ripening and termination of the introduction of transition and the type and amount of halogen added are determined by a trial-and-error experimentation.

It is important to control the halogen composition of grains near the surface. It may be selected for a particular purpose whether the silver iodide content or the silver chloride content is increased near the surface because the adsorption of dyes and the development rate are altered thereby.

Although grain structures commonly have a flat surface, it is sometimes preferred to intentionally ruffle grain surfaces as described in JP-A 106532/1983, 221320/1985, and U.S. Pat. No. 4,643,966.

The grain size of the emulsion used in the invention can be evaluated in terms of the diameter of an equivalent circle to the projected area using an electron microscope, the diameter of an equivalent sphere to the grain volume calculated from the projected area and grain thickness, or the diameter of an equivalent sphere to the volume determined by the Coulter counter method. A choice may be made from a wide range covering from ultrafine grains having an equivalent sphere diameter of less than 0.01 μm to coarse grains an equivalent sphere diameter of greater than 10 μm. Preferably grains having a size of 0.1 to 3 μm are used as the photosensitive silver halide grains.

In order that the photosensitive material satisfy the desired gradation, emulsion layers having substantially identical color sensitivity can be such that two or more monodisperse silver halide emulsions of different grain sizes are mixed in a common layer or overlappingly coated as separate layers. Furthermore, two or more polydisperse silver halide emulsions or a combination of a monodisperse emulsion and a polydisperse emulsion may be used in admixture or in superposition.

The photographic emulsion used herein can be prepared by any methods as described in P. Glafkides, Chimie et Physique Photographique, Paul Montel, 1967, G. F. Duffin, Photographic Emulsion Chemistry, Focal Press, 1966, V. L. Zelikman et al, Making and Coating Photographic Emulsion, Focal Press, 1964, etc. It is also employable to form grains in the presence of excess silver, which is known as reverse mixing method. One special type of the double jet technique is by maintaining constant the pAg of a liquid phase in which silver halide is created, which is known as a controlled double jet technique. This technique results in a silver halide emulsion of grains having a regular crystalline form and a nearly uniform particle size.

A method of adding previously precipitation formed silver halide grains to a reaction vessel for emulsion preparation as described in U.S. Pat. Nos. 4,334,012, 4,301,241 and 4,150,994 is sometimes preferred. These grains may be used as seed crystals or effectively supplied as silver halide for growth. It is sometimes effective for modifying the surface to add fine grains of various halogen compositions.

Methods for converting the majority or only a part of the halogen composition of silver halide grains by a halogen conversion technique are disclosed in U.S. Pat. Nos. 3,477,852, 4,142,900, EP 273,429, 273,430 and West German OS 3,819,241. A solution of soluble halogen or silver halide grains may be added to convert into a more difficultly soluble silver salt.

Besides the method of conducting grain growth by adding a soluble silver salt and a halide salt at a constant concentration and a constant flow rate, a grain forming method of changing a concentration or flow rate is preferred as described in UKP 1,469,480 and U.S. Pat. Nos. 3,650,757 and 4,242,445. By increasing a concentration or a flow rate, the amount of silver halide supplied can be changed as a linear, quadratic or more complex function of an addition time.

The mixer used when a soluble silver salt solution is reacted with a soluble halide salt solution may be selected from those described in U.S. Pat. Nos. 2,996,287, 3,342,605, 3,415,650, 3,785,777 and West German OS 2,556,885 and 2,555,364.

A silver halide solvent is useful for the purpose of promoting the ripening. For example, it is known to add an excess amount of halide ion in the reactor for promoting the ripening. Other ripening agents may be used. These ripening agents may be entirely blended in a dispersing medium in the reactor before the addition of silver and halide salts or introduced into the reactor at the same time as the halide salt, silver salt or peptizer are added.

Exemplary ripening agents include ammonia, thiocyanate salts (e.g., potassium thiocyanate and ammonium thiocyanate), organic thioether compounds (for example, the compounds described in U.S. Pat. Nos. 3,574,628, 3,021,215, 3,057,724, 3,038,805, 4,276,374, 4,297,439, 3,704,130, 4,782,013, and JP-A 104926/1982), thion compounds (for example, tetra-substituted thioureas as described in JP-A 82408/1978, 77737/1980, and U.S. Pat. No. 4,221,863, and compounds as described in JP-A 144319/1978), mercapto compounds and amine compounds capable of promoting the growth of silver halide grains (e.g., JP-A 100717/1979).

Gelatin is advantageously used as the protective colloid used in the preparation of the silver halide emulsion according to the present invention and as a binder for other hydrophilic colloid layers. The use of other hydrophilic colloids is also acceptable. Useful are gelatin derivatives, graft polymers of gelatin with other polymers, proteins such as albumin and casein; cellulose derivatives such as hydroxyethylcellulose, carboxymethyl cellulose and cellulose sulfate ester; sucrose derivatives such as sodium alginate and starch derivatives; and various other synthetic hydrophilic polymers such as polyvinyl alcohol, polyvinyl alcohol partial acetal, poly-N-vinyl pyrrolidone, polyacrylic acid, polymethacrylic acid, polyacrylamide, polyvinylimidazole, and polyvinylpyrazole, alone or copolymers thereof.

Examples of the gelatin used include lime treated gelatin, acid treated gelatin, and enzyme treated gelatin as described in Bull. Soc. Sci. Phot., Japan, No. 16, p 30 (1966) as well as hydrolyzed and enzymatically decomposed products of gelatin. The use of low molecular weight gelatin as described in JP-A 158426/1989 is preferred for the preparation of tabular grains.

The emulsion of the invention is preferably washed with water for desalting and dispersed in a newly prepared protective colloid. The temperature of water washing may be selected for a particular purpose and preferably in the range of 5° to 50° C. The pH upon water washing may also be selected for a particular purpose and preferably in the range of 2 to 10, more preferably in the range of 3 to 8. The pAg upon water washing may also be selected for a particular purpose and preferably in the range of 5 to 10. The washing method may be selected from noodle washing, dialysis using an osmosis membrane, centrifugation, flocculation, and ion exchange. The flocculation method may be selected from methods using sulfates, organic solvents, water-soluble polymers, and gelatin derivatives.

It is preferred for a particular purpose that a salt of a metal ion be present during preparation of the emulsion according to the invention, for example, during grain formation, during desalting, during chemical sensitization and before coating. Where grains are doped with a metal ion, it is preferably added upon grain formation. Where a metal ion is used for the modification of a grain surface or as a chemical sensitizer, it is preferably added after grain formation and before the completion of chemical sensitization. Grains may be entirely doped. Alternatively, only the core or only the shell or only an epitaxial portion of grains or only substrate grains may be doped. The metals which can be used include Mg, Ca, Sr, Ba, Al, Sc, Y, LaCr, Mn, Fe, Co, Ni, Cu, Zn, Ga, Ru, Rh, Pd, Re, Os, Ir, Pt, Au, Cd, Hg, Tl, In, Sn, Pb, and Bi. These metals may be added in the form of salts which can be dissolved upon grain formation, for example, ammonium salts, acetate salts, nitrate salts, sulfate salts, phosphate salts, hydroxide salts, six-coordinate complex salts, and four-coordinate complex salts. Examples are $CdBr_2$, $CdCl_2$, $Cd(NO_3)_2$, $Pb(NO_3)_2$, $Pb(CH_3COO)_2$, $K_3|Fe(CN)_5|$, $(NH_4)_4|Fe(CN)_6|$, $K_3IrCl_6$, $(NH_4)_3RhCl_6$, and $K_4Ru(CN)_6$. The ligand of coordinate compounds may be selected from halo, aquo, cyano, cyanate, thiocyanate, nitrosil, thionitrosil, oxo, and carbonyl ligands. These metal compounds may be used alone or in admixture of two or more.

It is sometimes useful to add chalcogen compounds as described in U.S. Pat. No. 3,772,031 during preparation of an emulsion. Besides S, Se and Te, there may be present cyanates, thiocyanates, selenocyanates, carbonates, phosphates and acetates.

The silver halide grains according to the invention may be subject to at least one of sulfur sensitization, selenium sensitization, tellurium sensitization (these three are generally designated chalcogen sensitization), noble metal sensitization and reduction sensitization at any step of the process of preparing the silver halide emulsion. A combination of two or more sensitization methods is preferred. Various types of emulsion can be prepared depending on the step when chemical sensitization is performed. There are emulsions of the type wherein chemical sensitization nuclei are buried in the interior of grains, the type wherein chemical sensitization nuclei are buried at a shallow position from the grain surface, and the type wherein chemical sensitization nuclei are formed at the grain surface. For the emulsion of the invention, the position of chemical sensitization nuclei can be selected depending on a particular purpose.

The chemical sensitization which is advantageously performed in the practice of the invention is either one or a combination of chalcogen sensitization and noble metal sensitization. The chemical sensitization may be performed using active gelatin as described in T. H. James, The Theory of The Photographic Process, 4th Ed., Macmillan, 1977, pages 67–76. Also, the chemical sensitization may be performed at pAg 5 to 10, pH 5 to 8, a temperature of 30° to 80° C. with a sensitizer such as sulfur, selenium, tellurium, gold, platinum, palladium, iridium, and a mixture thereof as described in Research Disclosure, Item 12008 (April 1974), ibid., Item 13452 (June 1975), ibid., Item 307105 (November 1989), U.S. Pat. Nos. 2,642,361, 3,297,446, 3,772,031, 3,857,711, 3,901,714, 4,266,018 and 3,904,415 and UKP 1,315,755.

In the sulfur sensitization, unstable sulfur compounds are used, for example, thiosulfates (e.g., hypo), thioureas (e.g., diphenylthiourea, triethylthiourea and allylthiourea), rhodanines, mercapto compounds, thioamides, thiohydantoins, 4-oxo-oxazolidine-2-thiones, di- or polysulfides, polythionates, and elemental sulfur as well as well-known sulfur-containing compounds as described in U.S. Pat. Nos. 3,857,711, 4,266,018 and 4,054,457. Sulfur sensitization is often combined with noble metal sensitization.

For the silver halide grains according to the invention, the preferred amount of sulfur sensitizer used is $1\times10^{-7}$ to $1\times10^{-3}$ mol, more preferably $5\times10^{-7}$ to $1\times10^{-4}$ mol per mol of the silver halide.

In the selenium sensitization, known unstable selenium compounds are used, for example, selenium compounds as described in U.S. Pat. Nos. 3,297,446 and 3,297,447. More particularly, useful selenium compounds are, for example, colloidal metallic selenium, selenoureas (e.g., N,N-dimethylselenourea and tetramethylselenourea), selenoketones (e.g., selenoacetone), selenoamides (e.g., selenoacetamide), selenocarboxylic acids and esters, isoselenocyanates, selenides (e.g., diethylselenide and triphenylphosphine selenide), and selenophosphates (e.g., tri-p-tolylselenophosphate). It is sometimes preferred to combine selenium sensitization with either one or both of sulfur sensitization and noble metal sensitization.

The preferred amount of selenium sensitizer used is $1\times10^{-8}$ to $1\times10^{-4}$ mol, more preferably $1\times10^{-7}$ to $1\times10^{-5}$ mol per mol of the silver halide although it varies with a particular selenium compound, silver halide grains and chemical ripening conditions.

The tellurium sensitizer used herein may be selected from compounds as described in Canadian Patent No. 800,958, UKP 1,295,462, 1,396,696, JP-A 333819/1990 and 131598/1991.

In the noble metal sensitization, salts of noble metals such as gold, platinum, palladium and iridium may be used. Inter alia, gold sensitization, palladium sensitization and a combination thereof are preferred. The gold sensitization may use well-known compounds such as chloroauric acid, potassium chloroaurate, potassium aurithiocyanate, gold sulfide, and gold selenide. Palladium compounds are divalent and tetravalent palladium salts. Preferred palladium compounds are represented by $R_2PdX6$ and $R_2PdX_4$ wherein R is a hydrogen atom, alkali metal atom or ammonium group and X is a halogen atom such as chlorine, bromine and iodine. Exemplary preferred examples are $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$. Gold compounds and palladium compounds are preferably used in combination with thiocyanates or selenocyanates.

For the emulsion of the invention, the use of gold sensitization is preferred. The preferred amount of gold sensitizer used is $1\times10^{-7}$ to $1\times10^{-3}$ mol, more preferably $5\times10^{-7}$ to $5\times10^{-4}$ mol per mol of the silver halide. The preferred amount of the palladium compound used is $5\times10^{-7}$ to $1\times10^{-3}$ mol per mol of the silver halide. The preferred amount of the thiocyan or selenocyan compound used is $1\times10^{-6}$ to $5\times10^{-2}$ mol per mol of the silver halide.

The silver halide emulsion of the invention is preferably subject to reduction sensitization during grain formation, after grain formation and before chemical sensitization, during chemical sensitization, or after chemical sensitization. The reduction sensitization may be selected from a method of adding a reduction sensitizer to the silver halide emulsion, a method of growing or ripening in a low pAg atmosphere at pAg 1 to 7, known as silver ripening, and a method of growing or ripening in a high pH atmosphere at pH 8 to 11, known as high pH ripening. Two or more of these methods may be combined. The reduction sensitizer may be selected from known compounds such as stannous salts, ascorbic acid and derivatives thereof, amines and polyamines, hydrazine and derivatives thereof, formamidinesulfinic acid, silane compounds, and boran compounds alone or in admixture of two or more. Preferred reduction sensitizers are stannous chloride, aminoiminomethanesulfinic acid (generally designated thiourea dioxide), dimethylaminoboran, ascorbic acid and derivatives thereof.

The chemical sensitization may be performed in the presence of a so-called chemical sensitization aid. Useful chemical sensitization aids include compounds which suppress fog and increase sensitivity during chemical sensitization, for example, azaindenes, azapyridazines and azapyrimidines. Examples of the chemical sensitization aids and modifiers are described in U.S. Pat. Nos. 2,131,038, 3,411,914, 3,554,757, JP-A 126526/1983 and the above-referred Duffin, Photographic Emulsion Chemistry, pp. 138–143.

It is preferred to use an oxidizing agent for silver in the process of preparing the emulsion of the invention. The oxidizing agent for silver designates a compound which acts on metallic silver to convert it into a silver ion. Especially useful are those compounds which convert very fine silver grains produced in the silver halide grain forming step and chemical sensitization step as a by-product into silver ions. The thus created silver ion may form either a silver salt difficultly soluble in water such as silver halide, silver sulfide, and silver selenide or a silver salt easily soluble in water such as silver nitrate. The oxidizing agent for silver may be either inorganic or organic. Exemplary inorganic oxidizing agents include ozone, hydrogen peroxide and addition products thereof (e.g., $NaBO_2.H_2O_2.3H_2O$, $2NaCO_3.3H_2O_2$, $Na_4P_2O_7.2H_2O_2$, and $2Na_2SO4.H_2O_2.2H_2O$), oxyacid salts such as peroxyacid salts (e.g. $K_2S_2O_8$, $K_2C_2O_6$, and $K_2P_2O_8$), peroxy complex compounds (e.g., $K_2[Ti(O_2)\ C_2O_4].3H_2O$, $4K_2SO_4.\ Ti\ (O_2)\ OH.SO_4.2H_2O$, and $Na_3[VO(O_2)\ (C_2H_4)_2.6H_2O)$, permanganates (e.g., $KMnO_4$), and chromates (e.g., $K_2Cr_2O_7$), halogens such as iodine and bromine, perhalogenoic acid salts (e.g., potassium periodate), high valence metal salts (e.g., potassium hexacyanoferrate), and thiosulfonates. Examples of the organic oxidizing agent include quinones such as p-quinone, organic peroxides such as peracetic acid and perbenzoic acid, and compounds releasing active halogen such as N-bromosuccinimide, chloramine T and chloramine B. In one preferred embodiment, the oxidizing agent for silver is combined with the above-mentioned reduction sensitizer.

Additionally, the photographic emulsion used herein may contain various additives for the purposes of preventing fog during preparation, shelf storage and photographic processing of the photosensitive material and stabilizing photographic performance. Useful additives include a number of compounds generally known as antifoggants and stabilizers, for example, thiazoles (e.g., benzothiazolium salts), nitroimidazoles, nitrobenzimidazoles, chlorobenzimidazoles, bromobenzimidazoles, mercaptothiazoles, mercaptobenzothiazoles, mercapbenzimidazoles, mercaptothiadiazoles, aminotriazoles, benzothiazoles, nitrobenzotriazoles, and mercaptotetrazoles (e.g., 1-phenyl-5-mercaptotetrazole);

mercaptopyrimidines; mercaptotriazines; thioketo compounds (e.g., oxazolinethion); azaindenes, for example, triazaindenes, tetraazaindenes (e.g., 4-hydroxy-6-methyl-(1,3,3a,7)-tetraazaindene), and pentaazaindenes. For-example, the compounds described in U.S. Pat. Nos. 3,954,474, 3,982,947 and JP-B 28660/1977 may be used. Other preferred compounds are described in Japanese Patent Application No. 47225/1987. Depending on a particular purpose, the antifoggants and stabilizers may be added at any desired stage, for example, before, during and after grain formation, during water washing, during dispersion after washing, before, during and after chemical sensitization, and before coating.

Better results are obtained when the photographic emulsion of the invention is spectrally sensitized with methine dyes and the like. The dyes useful for spectral sensitization include cyanine dyes, merocyanine dyes, complex cyanine dyes, complex merocyanine dyes, holopolar cyanine dyes, hemicyanine dyes, styryl dyes, and hemioxonol dyes. Particularly useful dyes among them are cyanine, merocyanine, and complex merocyanine dyes. To these dyes, any nuclei generally utilized for cyanine dyes can be applied as basic heterocyclic ring nuclei. For example, applicable are pyrroline nuclei, oxazoline nuclei, thiazolin nuclei, pyrrole nuclei, oxazole nuclei, thiazole nuclei, selenazole nuclei, imidazole nuclei, tellurazole nuclei, pyridine nuclei, etc.; and nuclei of the foregoing nuclei having a cycloaliphatic hydrocarbon ring fused thereto and nuclei of the foregoing nuclei having an aromatic hydrocarbon ring fused thereto, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may be substituted on a carbon atom(s).

For the merocyanine and complex merocyanine dyes, those nuclei generally used for merocyanine dyes are applicable as a nucleus having a ketomethylene structure, for example, 5-or 6-membered heterocyclic nuclei such as a pyrazolin-5-one nucleus, thiohydantoin nucleus, 2-thiooxazolidin-2,4-dione nucleus, thiazolidin-2,4-dione nucleus, rhodanine nucleus, and thiobarbituric acid nucleus.

These sensitizing dyes may be used alone or in combination. Combinations of sensitizing dyes are often used particularly for the purpose of supersensitization. Typical examples are found in the following patents.

| | | |
|---|---|---|
| USP 2,688,545 | 2,977,229 | 3,397,060 |
| 3,522,052 | 3,527,641 | 3,617,293 |
| 3,628,964 | 3,666,480 | 3,672,898 |
| 3,679,428 | 3,703,377 | 3,769,301 |
| 3,614,609 | 3,837,862 | 4,026,707 |
| UKP 1,344,281 | 1,507,803 | |
| JP-B 4936/1968 | 12375/1978 | |
| JP-A 110618/1977 | 109925/1977 | |

A dye which itself does not have spectral sensitization function or a compound which does not substantially absorb visible light and provides supersensitization may be contained in the emulsion along with the sensitizing dye.

The sensitizing dyes may be added to the emulsion at any stage of emulsion preparation which is known to be effective for the purpose. Although addition is most often done in a period from the completion of chemical sensitization to the start of coating, the sensitizing dye may also be added at the same time as the chemical sensitizer to concurrently perform spectral sensitization and chemical sensitization as described in U.S. Pat. Nos. 3,628,969 and 4,225,666 or added prior to chemical sensitization as described in JP-A 113928/1983, or added prior to the completion of silver halide grain precipitation to start spectral sensitization. It is also possible to add the sensitizing dye in divided portions as disclosed in U.S. Pat. No. 4,225,666, that is, to add a portion of the compound in advance to chemical sensitization and add the remainder after chemical sensitization. The sensitizing dyes may be added at any stage during silver halide grain formation, for example, by a method as disclosed in U.S. Pat. No. 4,183,756.

Using the above-mentioned emulsion, the photosensitive material of the invention is prepared. The preferred construction used in the photosensitive material of the invention is described below.

In the photosensitive material of the invention, the crossover light is preferably less than 20%, more preferably 2 to 10%. The crossover light is evaluated by the method described in JP-A 172828/1989. That is, the crossover light is defined, when a double-sided photosensitive material is exposed to light from only one side through a fluorescent screen, as the difference in sensitivity between the back surface emulsion layer and the front surface emulsion layer.

In the photosensitive material of the invention, a dye is preferably used as a crossover cutting layer between the support and the emulsion layer. The crossover cutting dye is described below.

Preferably used in the photosensitive material of the invention is a solid dispersion of a dye of the following general formula (I):

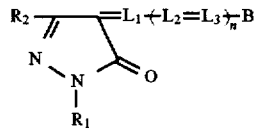

(I)

wherein $R_1$ is a hydrogen atom, alkyl, aryl or heterocyclic group; $R_2$ is a hydrogen atom, alkyl, aryl, heterocyclic, alkoxycarbonyl, aryloxycarbonyl, carbamoyl, acylamino, ureido, amino, acyl, alkoxy, aryloxy, hydroxy, carboxy, cyano, sulfamoyl or sulfonamide group; B is a 5- or 6-membered oxygen-containing heterocyclic group or 6-membered nitrogen-containing heterocyclic group; $L_1$ to $L_3$ are methine groups; and letter n is 0 to 2. The compound of formula (I) should have at least one of carboxy, sulfonamide and sulfamoyl groups.

The compounds of the general formula (I) are described in more detail. The alkyl groups represented by $R_1$ and $R_2$ in formula (I) include methyl, ethyl, n-propyl, iso-propyl, t-butyl, n-pentyl, n-hexyl, n-octyl, 2-ethylhexyl, n-dodecyl, n-pentadecyl, and eicosyl groups. The alkyl groups may be substituted ones while the substituents include, for example, halogen atoms (e.g., chlorine, bromine, iodine and fluorine), aryl groups (e.g., phenyl and naphthyl), cycloalkyl groups (e.g., cyclopentyl and cyclohexyl), heterocyclic groups (e.g., pyrrolidyl, pyridyl, furyl, and thienyl), sulfinic acid groups, carboxyl groups, nitro groups, hydroxyl groups, mercapto groups, amino groups (e.g., amino and diethylamino), alkyloxy groups (e.g., methyloxy, ethyloxy, n-butyloxy, n-octyloxy, and isopropyloxy), aryloxy groups (e.g., phenyloxy and naphthyloxy), carbamoyl groups (e.g., aminocarbonyl, methylcarbamoyl, n-pentylcarbamoyl, and phenylcarbamoyl), amide groups (e.g., methylamide, benzamide, and n-octylamide), aminosulfonylamino groups (e.g., aminosulfonylamino, methylaminosulfonylamino, and anilinosulfonylamino), sulfamoyl groups (e.g., sulfamoyl, methylsulfamoyl, phenylsulfamoyl, and n-butylsulfamoyl), sulfonamide groups (e.g., methanesulfonamide, n-heptanesulfonamide, and benzenesulfonamide), sulfinyl groups (e.g., alkylsulfinyl groups such as methylsulfinyl, ethylsulfinyl, and octylsulfinyl, and arylsulfinyl groups such as phenylsulfinyl), alkyloxycarbonyl groups (e.g., methyloxycarbonyl, ethyloxycarbonyl, 2-hydroxyethyloxycarbonyl, and n-octyloxycarbonyl), aryloxycarbonyl groups (e.g., phenyloxycarbonyl and naphthyloxycarbonyl), alkylthio groups (e.g., methylthio, ethylthio, and n-hexylthio), arylthio groups (e.g., phenylthio and naphthylthio), alkylcarbonyl groups (e.g., acetyl, ethylcarbonyl, n-butylcarbonyl, and n-octylcarbonyl), arylcarbonyl groups (e.g., benzoyl, p-methanesulfonamidebenzoyl, p-carboxybenzoyl, and naphthoyl), cyano groups, ureido groups (e.g., methylureido and phenylureido), and thioureido groups (e.g., methylthioureido and phenylthioureido).

The aryl groups represented by $R_1$ and $R_2$ include phenyl and naphthyl groups. The aryl groups may be substituted ones wherein the substituents are as exemplified just above as the alkyl groups and the substituents thereon.

The heterocyclic groups represented by $R_1$ and $R_2$ include pyridyl groups (e.g., 2-pyridyl, 3-pyridyl, 4-pyridyl, 5-carboxy-2-pyridyl, 3,5-dichloro-2-pyridyl, 4,6-dimethyl-2-pyridyl, 6-hydroxy-2-pyridyl, 2,3,5,6-tetrafluoro-4-pyridyl, and 3-nitro-2-pyridyl), oxazolyl groups (e.g., 5-carboxyl-2-benzoxazolyl, 2-benzoxazolyl, and 2-oxazolyl), thiazolyl groups (e.g., 5-sulfamoyl-2-benzothiazolyl, 2-benzothiazolyl, and 2-thiazolyl), imidazolyl groups (e.g., 1-methyl-2-imidazolyl and 1-methyl-5-carboxy-2-benzimidazolyl), furyl groups (e.g., 3-furyl), pyrrolyl groups (e.g., 3-pyrrolyl), thienyl groups (e.g., 2-thienyl), pyrazinyl groups (e.g., 2-pyrazinyl), pyrimidinyl groups (e.g., 2-pyrimidinyl and 4-chloro-2-pyrimidinyl), pyridazinyl groups (e.g., 2-pyridazinyl), purinyl groups (e.g., 8-purinyl), isooxazolyl groups (e.g., 3-isooxazolyl), selenazolyl groups (e.g., 5-carboxy-2-selenazolyl), sulforanyl groups (e.g., 3-sulforanyl), piperidinyl groups (e.g., 1-methyl-3-piperidinyl), pyrazolyl groups (e.g., 3-pyrazolyl), and tetrazolyl groups (e.g., 1-methyl-5-tetrazolyl). The heterocyclic groups may be substituted ones wherein the substituents are as exemplified above as the alkyl groups and the substituents thereon.

Examples of the alkoxycarbonyl group represented by $R_2$ include methoxycarbonyl, ethoxycarbonyl, i-propoxycarbonyl, t-butoxycarbonyl, pentyloxycarbonyl and dodecyloxycarbonyl groups. Examples of the aryloxycarbonyl group represented by $R_2$ include phenyloxycarbonyl and naphthyloxycarbonyl groups. Examples of the carbamoyl group represented by $R_2$ include aminocarbonyl, methylcarbamoyl, ethylcarbamoyl, i-propylcarbamoyl, t-butylcarbamoyl, dodecylcarbamoyl, phenylcarbamoyl, 2-pyridylcarbamoyl, 4-pyridylcarbamoyl, benzylcarbamoyl, morpholinocarbamoyl, and piperazinocarbamoyl groups. Examples of the acylamino group represented by $R_2$ include methylcarbonylamino, ethylcarbonylamino, i-propylcarbonylamino, t-butylcarbonylamino, dodecylcarbonylamino, phenylcarbonylamino, and naphthylcarbonylamino groups. Examples of the ureido group represented by $R_2$ include methylureido, ethylureido, i-propylureido, t-butylureido, dodecylureido, phenylureido, 2-pyridylureido, and thiazolylureido groups. Examples of the amino group represented by $R_2$ include amino, methylamino, ethylamino, i-propylamino, t-butylamino, octylamino, dodecylamino, dimethylamino, anilino, naphthylamino, morpholino and piperazino groups. Examples of the acyl group represented by $R_2$ include methylcarbonyl, ethylcarbonyl, i-propylcarbonyl, t-butylcarbonyl, octylcarbonyl, dodecylcarbonyl, phenylcarbonyl, and naphthylcarbonyl groups. Examples of the alkoxy group represented by $R_2$ include methoxy, ethoxy, i-propoxy, t-butyloxy, and dodecyloxy groups. Examples of the aryloxy group represented by $R_2$ include phenoxy and naphthyloxy groups. Examples of the sulfamoyl group represented by $R_2$ include aminosulfonyl, methylsulfamoyl, i-propylsulfamoyl, t-butylsulfamoyl, dodecylsulfamoyl, phenylsulfamoyl, 2-pyridylsulfamoyl, 4-pyridylsulfamoyl, morpholinosulfamoyl, piperazinosulfamoyl groups. Examples of the sulfonamide group represented by $R_2$ include methylsulfonamide, ethylsulfonamide, i-propylsulfonamide, t-butylsulfonamide, dodecylsulfonamide, phenylsulfonamide, and naphthylsulfonamide groups. These groups include substituted ones wherein the substituents are as exemplified above as the alkyl groups represented by $R_1$ and $R_2$ and the substituents thereon.

In formula (I), B is a 5- or 6-membered oxygen-containing heterocyclic group or 6-membered nitrogen-containing heterocyclic group, examples of which include furyl groups (e.g., 2-furyl, 3-furyl, 2-benzofuranyl, 3-benzofuranyl, and 1-isobenzofuranyl), pyranyl groups (e.g., 2-tetrahydropyranyl, 3-2H-pyranyl, 4-2H-pyranyl, 5-2H-pyranyl, 6-2H-pyranyl, 2-4H-pyranyl, 3-4H-pyranyl, 2-chromanyl, 3-chromanyl, 4-2H-chromenyl, and 2-4H-chromenyl), pyronyl groups (e.g., 2-4H-pyronyl, 3-4H-pyronyl, 2-chromonyl, 3-cumarinyl, and 3-chromonyl), pyridyl groups (e.g., 2-pyridyl, 3-pyridyl, 4-pyridyl, 2-quinolyl, 3-quinolyl, 4-quinolyl, 9-acrydinyl, and 3-thienopyridyl), pyrazinyl groups (e.g., 2-pyrazinyl), pyrimidinyl groups (e.g., 2-pyrimidinyl, 4-pyrimidinyl, 5-pyrimidinyl, and 2-quinazolynyl), and piperidinyl groups (e.g., 3-piperidinyl). The heterocyclic groups include substituted ones wherein the substituents are as exemplified above as the alkyl groups represented by $R_1$ and $R_2$, the substituents thereon and the amino, alkoxy and aryloxy groups represented by $R_2$.

In formula (I), the methine groups represented by $L_1$ to $L_3$ include substituted ones. Exemplary substituents include alkyl groups (e.g., methyl, ethyl, isopropyl, t-butyl, 3-hydroxypropyl, and benzyl), aryl groups (e.g., phenyl), halogen atoms (e.g., chlorine, bromine, iodine and fluorine), alkoxy groups (e.g., methoxy and ethoxy), and acyloxy groups (e.g., methylcarbonyloxy and phenylcarbonyloxy).

Several illustrative, non-limiting examples of the compound of formula (I) are given below. Exemplary compounds are represented by combinations of B and R in structural formulae encompassed in formula (I). It is noted that where $R_3$ is a substituent, the number preceding the substituent indicates its bond position, and that there can be more than one substituent represented by $R_3$.

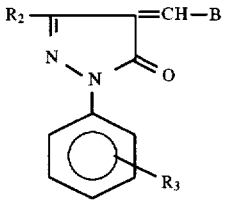
| Compound No. | $R_2$ | $R_3$ | B |
|---|---|---|---|
| 1-1 | $-CH_3$ | 4-COOH | 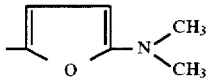 |
| 1-2 | $-COOC_2H_5$ | 4-COOH | 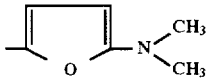 |
| 1-3 | $-CONH_2$ | 4-COOH | 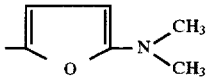 |
| 1-4 | $-COCH_3$ | 4-COOH | 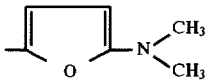 |
| 1-5 | $-CN$ | 4-COOH | 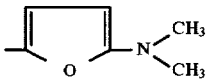 |
| 1-6 | $-CONH_2$ | $4-SO_2NH_2$ | 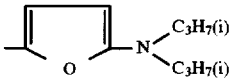 |
| 1-7 | 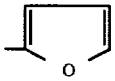 | 2-COOH, 5-COOH | 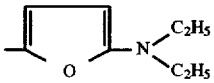 |
| 1-8 | $-OC_2H_5$ | 3-COOH | 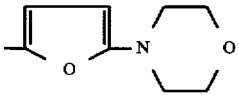 |
| 1-9 | $-COCH_3$ | 2-COOH | 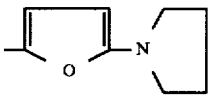 |
| 1-10 | $-COOC_2H_5$ | $4-NHSO_2CH_3$ | 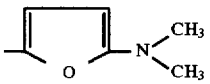 |
| 1-11 | $-COOH$ | $4-NHSO_2CH_3$ | 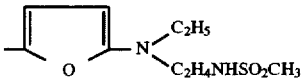 |
| 1-12 | $-CONH_2$ | 2-COOH, 5-COOH | 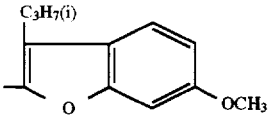 |
| 1-13 | $-COCH_3$ | 3-COOH | 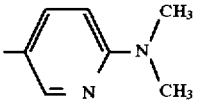 |

-continued

| | | | |
|---|---|---|---|
| 1-14 | $-COCH_3$ | 4-COOH | 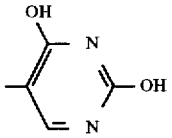 |
| 1-15 | $-COC_2H_5$ | 4-COOH | 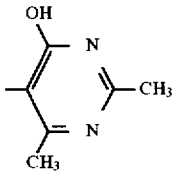 |
| 1-16 | $-COOCH_3$ | 4-COOH | 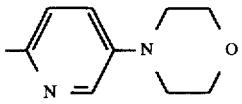 |
| 1-17 | $-COCH_3$ | 2-COOH, 5-COOH | 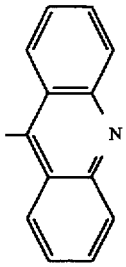 |
| 1-18 | $-COOH$ | H | 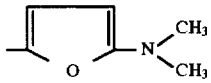 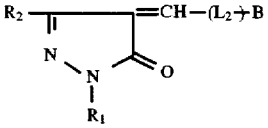 |

| Compound No. | $R_2$ | $R_1$ | $L_2$ | B |
|---|---|---|---|---|
| 1-19 | $-COOC_2H_5$ | 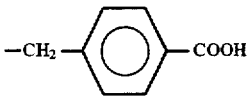 | — | 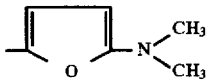 |
| 1-20 | 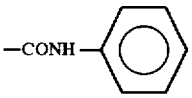 | $-CH_2COOH$ | — | 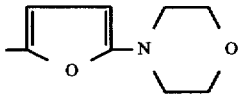 |
| 1-21 | $-COOH$ | $-CH_3$ | — | 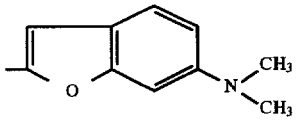 |
| 1-22 | $-NHCONHCH_3$ | $-CH_2COOH$ | $-CH=CH-$ | 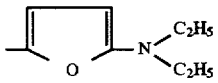 |

In one preferred embodiment of the photosensitive material of the invention, a film which is effectively dried and resistant to pressure can be constructed using a specific polymer.

A polymer latex obtained by polymerizing a difficultly soluble monomer is advantageously used in the photosensitive material of the invention. Such monomers are first described.

The preferred monomers are acrylate compounds, especially combinations of an acrylate compound and a methacrylate compound. The polymer latex preferably has a particle size of less than 300 nm.

The polymer latex is preferably prepared by polymerizing the monomer in the presence of a water-soluble polymer and/or a surfactant. The surfactants used upon polymerization of the polymer latex include anionic, nonionic, cationic and ampholytic surfactants, with the anionic and/or nonionic surfactants being preferred. The anionic and nonionic surfactants used herein may be selected from such compounds well known in the art. The anionic surfactants are especially preferred. The water-soluble polymers used upon polymerization of the polymer latex include synthetic polymers and natural water-soluble polymers which are both preferred in the practice of the invention. The synthetic water-soluble polymers include polymers having a nonionic group, an anionic group, a cationic group, both a nonionic group and an anionic group, both a nonionic group and a cationic group, and both an anionic group and a cationic group in their molecular structure. Exemplary nonionic groups are ether, alkylene oxide, hydroxy, amide and amino groups. Exemplary anionic groups include carboxylic acid groups or salts thereof, phosphoric acid groups or salts thereof, and sulfonic acid groups or salts thereof. Exemplary cationic groups include quaternary ammonium salt groups and tertiary amino groups.

The natural water-soluble polymers include polymers having a nonionic group, an anionic group, a cationic group, both a nonionic group and an anionic group, both a nonionic group and a cationic group, and both an anionic group and a cationic group in their molecular structure.

Whether they are synthetic or natural water-soluble polymers, the water-soluble polymers used upon polymerization of the polymer latex should preferably have an anionic group or both a nonionic group and an anionic group.

The water-soluble polymer has a solubility of more than 0.05 gram, preferably more than 0.1 gram in 100 grams of water at 200° C.

The natural water-soluble polymers include those described in "Comprehensive Technical Data Collection of Water-Soluble High-Molecular Weight Water Dispersion Resins," Keiei Kaihatsu Center. Preferred examples include lignin, starch, pluran, cellulose, dextran, dextrin, glycogen, alginic acid, gelatin, collagen, guar gum, gum arabic, laminaran, lichenin, nigeran, and derivatives thereof. Preferred derivatives of natural water-soluble polymers are sulfonate, carboxyl, phosphate, sulfoalkylene, carboxyalkylene, and alkylphosphate derivatives and salts thereof. Especially preferred are glucose, gelatin, dextran, cellulose and derivatives thereof.

The polymer latex may be readily prepared by various methods. For example, polymers obtained by emulsion polymerization, solution polymerization or bulk polymerization are dispersed again.

In the case of emulsion polymerization, a polymer latex is prepared by using water as a dispersing medium, 10 to 50% by weight based on water of a monomer, 0.05 to 5% by weight based on the monomer of a polymerization initiator, and 0.1 to 20% by weight based on the monomer of a dispersant, and effecting polymerization with stirring at about 30° to 100° C., preferably 60° to 90° C. for about 3 to 8 hours. The monomer concentration, initiator amount, reaction temperature and time may be easily changed in a wide range. Exemplary initiators are water-soluble peroxides (e.g., potassium persulfate and ammonium persulfate) and water-soluble azo compounds (e.g., 2,2'-azobis(2-aminodipropane)-hydrochloride). Exemplary dispersants are water-soluble polymers as well as anionic, nonionic, cationic and ampholytic surfactants, alone or in admixture. Preferably a water-soluble polymer is used in admixture with a nonionic or anionic surfactant.

In the case of solution polymerization, a polymer latex is prepared by dissolving a mixture of monomers in a suitable solvent (e.g., ethanol, methanol and water) in a suitable concentration (usually less than 40% by weight, preferably 10 to 25% by weight based on the solvent) and heating the solution at an appropriate temperature (e.g., 40 to 120° C., preferably 50° to 100° C.) in the presence of a polymerization initiator (e.g., benzoyl peroxide, azobisisobutyronitrile and ammonium persulfate), thereby effecting copolymerization reaction. The reaction mixture is then poured into a medium in which the resultant copolymer is not soluble, whereupon the product settles out. By subsequent drying, the unreacted mixture is separated.

Next, the copolymer is dissolved in a solvent in which the copolymer is soluble, but which is insoluble in water (e.g., ethyl acetate and butanol). The mixture is vigorously dispersed in the presence of a dispersant (e.g., surfactants and water-soluble polymers) whereupon the solvent is distilled off, yielding a polymer latex.

The synthesis of polymer latices is discussed, for example, in U.S. Pat. Nos. 2,852,386, 2,853,457, 3,411,911, 3,411,912, 4,197,127, Belgian Patent No. 688,882, 691,360, 712,823, JP-B 5331/1970, JP-A 18540/1985, 130217/1976, 137831/1983, and 50240/1980.

Polymer latices having a mean particle size of 0.5 to 300 nm, especially 30 to 250 nm are preferably used. The particle size of polymer latices can be measured by an electron microscope technique, soap titration, light scattering, and centrifugation as described in "The Chemistry of Polymer Latex," Kobunshi Kankokai, 1973. The light scattering method is preferred. One exemplary meter based on light scattering is DLS700 by Otsuka Electronics K.K.

No particular limit is imposed on the molecular weight of the polymer latex although an overall molecular weight of about 1,000 to 1,000,000, especially about 2,000 to 500,000 is preferred.

In the practice of the invention, the polymer latex can be contained in a photographic layer as such or as a dispersion in water.

Several illustrative, non-limiting examples of the polymer latex are given below together with the dispersant used in the synthesis thereof. A suffix attached to a monomer unit represents a percent content (% by weight).

| | | dispersant |
|---|---|---|
| Lx-1 | $\leftarrow CH_2-\underset{\underset{COOCH_2CHC_4H_9}{\vert}}{CH}\rightarrow_{100}$ <br> $\vert$ <br> $C_2H_5$ | Sf-1 |

-continued

| | | |
|---|---|---|
| Lx-2 | $\leftarrow CH_2-CH\rightarrow_{100}$ (COOCH$_2$CHC$_4$H$_9$, C$_2$H$_5$) | P-3 |
| Lx-3 | $\leftarrow CH_2-CH\rightarrow_{100}$ (COOC$_4$H$_9$(iso)) | P-2 |
| Lx-4 | $\leftarrow CH_2-CH\rightarrow_{100}$ 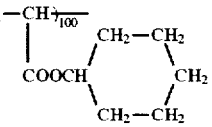 | P-1 |
| Lx-5 | $\leftarrow CH_2-CH\rightarrow_{98}$ (COOC$_4$H$_9$(iso)) $\leftarrow CH_2-CH\rightarrow_{2}$ 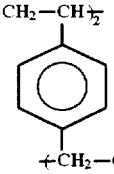 $\leftarrow CH_2-CH\rightarrow$ | P-3 |
| Lx-6 | $\leftarrow CH_2-CH\rightarrow_{33}$ (COOC$_9$H$_{19}$(iso)) $\leftarrow CH_2-CH\rightarrow_{43}$ 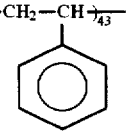 | Sf-2 |
| Lx-7 | $\leftarrow CH_2-C(CH_3)\rightarrow_{100}$ (COOCH$_2$CHC$_4$H$_9$, C$_2$H$_5$) | dispersant: dextran sulfate |
| Lx-8 | $\leftarrow CH_2-C(CH_3)\rightarrow_{100}$ (COOCH$_2$CHC$_4$H$_9$, C$_2$H$_5$) | Pf-4 |
| Lx-9 | $\leftarrow CH_2-C(CH_3)\rightarrow_{100}$ ($CH_2(CH_2)_{10}CH_3$) | Sf-1 |
| Lx-10 | $\leftarrow CH_2-C(CH_3)\rightarrow_{30}$ (COOC$_9$H$_{19}$(iso)) $\leftarrow CH_2-CH\rightarrow_{70}$ 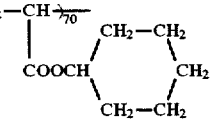 | Sf-2 |
| Lx-11 | $\leftarrow CH_2-C(CH_3)\rightarrow_{100}$ (COOC$_9$H$_{19}$(n)) | Sf-1 |
| Lx-12 | $\leftarrow CH_2-CH\rightarrow_{45}$ (COOC$_8$H$_{17}$(n)) $\leftarrow CH_2-C(CH_3)\rightarrow_{55}$ (COOMe) | Sf-3 |
| Lx-13 | $\leftarrow CH_2-CH\rightarrow_{40}$ (COOC$_8$H$_{17}$(n)) $-(CH_2-C(CH_3)\rightarrow_{50}$ (COOMe) $\leftarrow CH_2-C(CH_3)\rightarrow_{10}$ (COOCH$_2$CH—CH$_2$, O) | Sf-4 |

-continued
Lx-14 Sf-3
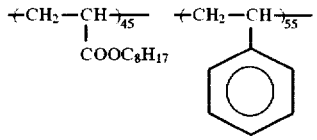
Lx-15 P-2
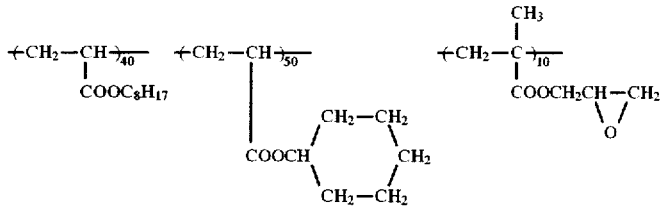
Lx-16 P-3
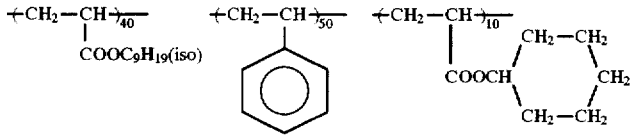
Lx-17 Sf-1
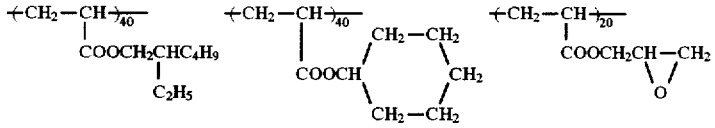
Lx-18 P-3
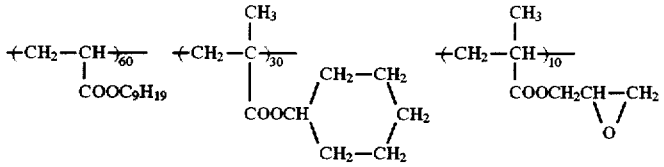
Lx-19 P-2 Sf-3
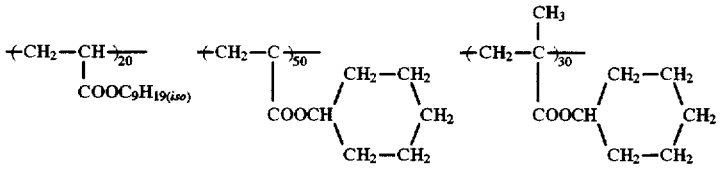
Lx-20 P-2 Sf-3
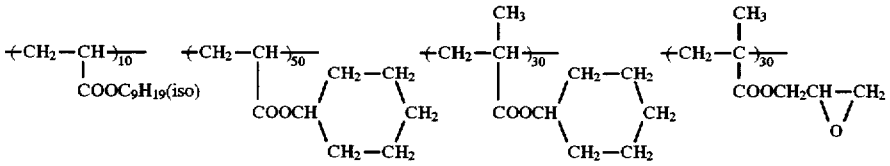
Lx-21 Sf-3
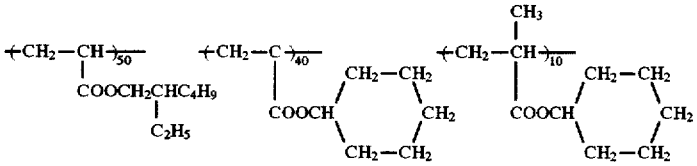
Sf-1
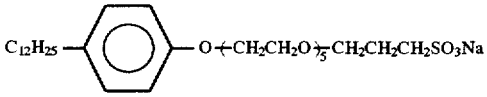
Sf-2
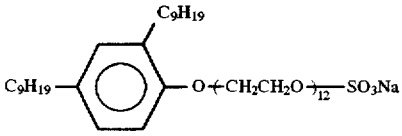

-continued

Sf-3

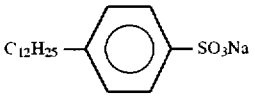

Sf-4 $C_{12}H_{25}OSO_3Na$

P-1

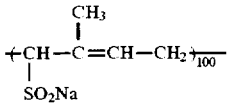

Mw = 5000

P-2

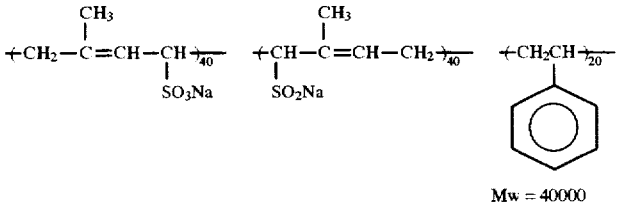

Mw = 40000

P-3

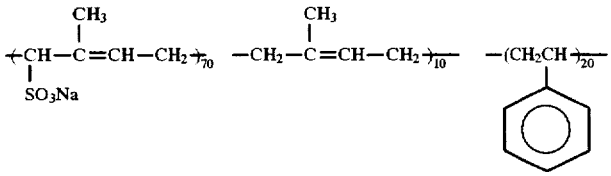

Mw = 40000

P-4

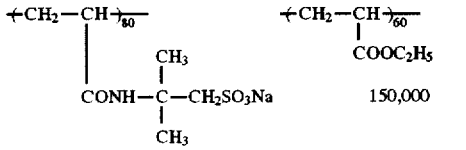

150,000

The polymer latex may be added to any layer in the photographic silver halide photosensitive material of the invention. Specifically, the polymer latex may be added to either one of a silver halide emulsion layer and another hydrophilic colloid layer, preferably both of them. More preferably, the polymer latex is added to both a silver halide emulsion layer and a hydrophilic colloid layer disposed remotest from the support. Best results are obtained when the polymer latex is added to both an emulsion layer and an uppermost protective layer thereon.

The amount of the polymer latex added is preferably in the range of 5 to 70% by weight based on the binder in a photographic layer. Outside the range, less amounts of the polymer latex would be less effective whereas more amounts of the polymer latex would exacerbate the photographic performance. Where the polymer latex is added to both the emulsion layer and the protective layer, the ratio of the amount of the polymer latex added to the protective layer to the amount of the polymer latex added to the emulsion layer preferably ranges from 3/10 to 4/10.

In one preferred embodiment of the photographic silver halide photosensitive material of the invention, colloidal silica is contained in the photosensitive silver halide emulsion layer. The colloidal silica preferably has a mean particle size of less than 0.1 μm, especially 0.005 to 0.08 μm. The colloidal silica contains silicon dioxide as a major component and may contain an aluminate as a minor component. Exemplary aluminates are sodium aluminate and potassium aluminate. In the colloidal silica, a stabilizer may be contained, for example, inorganic salts such as sodium hydroxide, potassium hydroxide, lithium hydroxide, and ammonium hydroxide, and organic salts such as tetramethylammonium ion. Commercially available examples of the colloidal silica include Ludox AM, Ludox AS, Ludox LS, Ludox TM and Ludox HS by E. I. duPont de Nemours & Co., Snowtex 20, Snowtex 30, Snowtex C, and Snowtex O by Nissan Chemical K.K., Syton C-30 and Syton 200 by Monsanto Co., and Nalcoag-1060 and Nalcoag-ID 21 to 64 by Nalco Chemical Co.

The amount of the colloidal silica added to the emulsion is preferably 0.05 to 1.5 g/m$^2$, more preferably 0.1 to 1.0 g/m$^2$. The colloidal silica may be diluted with water or a hydrophilic solvent before it is added to the emulsion. The colloidal silica may be added to the emulsion at any stage, preferably in any step after the completion of chemical ripening and before the start of coating.

In the photographic silver halide photosensitive material of the invention, the amount of silver halide used is preferably 0.5 to 1.5 g/m$^2$ calculated as the weight of silver on one surface. The amount of silver relative to the gelatin binder is not critical although the weight ratio of silver to gelatin is preferably in the range between 0.01 and 5.0, more preferably between 0.1 and 3.0.

Where the photographic silver halide photosensitive material of the invention has a plurality of silver halide emulsion layers, the emulsion layers may be disposed on one side of the support or on both sides of the support. The colloidal silica may be contained in all or some of the emulsion layers. Where the colloidal silica is contained in some of the emulsion layers, it is preferred that the colloidal silica be contained in the emulsion layer disposed remotest from the support.

In the photosensitive material of the invention, the coverage of gelatin should preferably be less than 2.1 g/m$^2$, more preferably 0.7 to 2.0 g/m$^2$ on one surface.

A matte agent may be used in the photosensitive material of the invention. Matte agents having a hydrophilic group are preferred although the invention is not limited thereto. The hydrophilic group used herein is a group which when introduced into a polymer, makes the polymer more soluble in water, for example, carboxyl, phosphate, sulfonate and sulfate groups, preferably carboxyl. Exemplary monomers having a carboxyl group as the hydrophilic group include acrylic acid, methacrylic acid, itaconic acid, maleic acid, fumaric acid, monoalkylmaleic acid, monoalkylcitraconic acid, and styrenecarboxylic acid. Exemplary of the monomer having a phosphate group as the hydrophilic group is a phosphate ester of hydroxyethyl acrylate. Exemplary monomers having a sulfonate group as the hydrophilic group include styrene sulfonic acid, methacryloyloxypropylsulfonic acid, and 2-acrylamido-2-methylpropanesulfonic acid. Exemplary of the monomer having a sulfate group as the hydrophilic group is a sulfate ester of hydroxyethyl acrylate.

Another monomer can be combined with the foregoing monomer to produce a copolymer. Such monomers are those having at least one ethylenic double bond, for example. They may be used alone or in admixture. Examples of the other monomer include acrylates such as methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 2-hydroxyethyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, ω-methoxypolyethyleneglycol acrylate (addition molar number n=9), 1-bromo-2-methoxyethyl acrylate, and 1,1-dichloro-2-ethoxyethyl acrylate.

Other exemplary monomers are methacrylates such as methyl methacrylate, ethyl methacrylate, n-propyl methacrylate, isopropyl methacrylate, n-propyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, sulfopropyl methacrylate, N-ethyl-N-phenylaminoethyl methacrylate, 2-(3-phenylpropyloxy) ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (addition molar number n=6), allyl methacrylate, and dimethylaminoethyl methacrylate methyl chloride.

Further exemplary monomers are vinyl esters such as vinyl acetate, vinyl propionate, vinyl butyrate, vinyl isobutyrate, vinyl caproate, vinyl chloroacetate, vinyl methoxyacetate, vinyl phenylacetate, vinyl benzoate, and vinyl salicylate.

Exemplary olefin monomers include dicyclopentadiene, ethylene, propylene, 1-butene, 1-pentene, vinyl chloride, vinylidene chloride, isoprene, chloroprene, butadiene, and 2,3-dimethylbutadiene.

Exemplary styrene monomers include styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, trifluoromethylstyrene, and methyl vinylbenzoate.

Exemplary crotonic acid esters include butyl crotonate and hexyl crotonate. Exemplary itaconic acid diesters include dimethyl itaconate, diethyl itaconate, and dibutyl itaconate. Exemplary maleic acid diesters include diethyl maleate, dimethyl maleate, and dibutyl maleate. Exemplary fumaric acid diesters include diethyl fumarate, dimethyl fumarate, and dibutyl fumarate.

Exemplary acrylamides include acrylamide, methyl acrylamide, ethyl acrylamide, propyl acrylamide, butyl acrylamide, tert-butyl acrylamide, cyclohexyl acrylamide, benzyl acrylamide, hydroxymethyl acrylamide, methoxyethyl acrylamide, dimethylaminoethyl acrylamide, phenyl acrylamide, dimethyl acrylamide, diethyl acrylamide, β-cyanoethyl acrylamide, and N-(2-acetoacetoxyethyl) acrylamide.

Exemplary methacrylamides include methacrylamide, methyl methacrylamide, ethyl methacrylamide, propyl methacrylamide, butyl methacrylamide, tert-butyl methacrylamide, cyclohexyl methacrylamide, benzyl methacrylamide, hydroxymethyl methacrylamide, methoxyethyl methacrylamide, dimethylaminoethyl methacrylamide, phenyl methacrylamide, dimethyl methacrylamide, diethyl methacrylamide, β-cyanoethyl methacrylamide, and N-(2-acetoacetoxyethyl) methacrylamide.

Exemplary allyl compounds include allyl acetate, allyl caproate, allyl laurate, and allyl benzoate. Exemplary vinyl ethers include methyl vinyl ether, butyl vinyl ether, hexyl vinyl ether, methoxyethyl vinyl ether, and dimethylaminoethyl vinyl ether. Exemplary vinyl ketones include methyl vinyl ketone, phenyl vinyl ketone, and methoxyethyl vinyl ketone. Exemplary vinyl heterocyclic compounds include vinyl pyridine, N-vinylimidazole, N-vinyloxazolidone, N-vinyltriazole, and N-vinylpyrrolidone. Exemplary glycidyl esters include glycidyl acrylate and glycidyl methacrylate. Exemplary unsaturated nitriles include acrylonitrile and methacrylonitrile. Exemplary polyfunctional monomers include divinyl benzene, methylene bisacrylamide, and ethylene glycol dimethacrylate.

Included in the polymer having such a hydrophilic group are copolymers having a molar ratio of methyl methacrylate to methacrylic acid of 1/1 as described in U.S. Pat. Nos. 2,992,102 and 3,767,448, copolymers having a molar ratio of methyl methacrylate to methacrylic acid of 6/4 to 9/1 as described in JP-A 7231/1978, ethyl methacrylate/methacrylic acid copolymers as described in JP-A 66937/1983, and ethyl methacrylate/methyl methacrylate/methacrylic acid copolymers as described in JP-A 126644/1985. Copolymers having a fluorine atom and an alkali solubilizing group are described in JP-A 14647/1987 and 15543/1987. Particulates of these polymers are advantageously used as the matte agent in the practice of the invention although the matte agent is not limited thereto.

In the practice of the invention, the polymers serving as the matte agent are preferably those polymers wherein the content of a monomer component having a hydrophilic group is 2 to 70 mol %, more preferably 3 to 50 mol %, most preferably 5 to 20 mol %.

The matte agent is preferably contained in the protective layer in an amount of 0.001 to 0.3 g/m$^2$, more preferably 0.01 to 0.15 g/m$^2$ and preferably has a mean particle size of 2 to 15 μm, more preferably 2 to 8 μm. Better results are obtained when the above-defined matte agent accounts for more than 30%, preferably more than 50% by weight of the entire amount of the matte agent coated. The other matte agent used in admixture with the above-defined matte agent is not critical and includes organic compounds such as polymethyl methacrylate and polystyrene and inorganic compounds such as silicon dioxide. When a mixture of two or more such matte agents is used, their effect is, of course, exerted.

Preferably at least 70%, more preferably at least 80%, most preferably at least 90% by weight of the entire matte agent used in the photosensitive material of the invention is present in the protective layer.

Preferred examples of the matte agent include mixtures of methyl methacrylate and methacrylic acid in a weight ratio between 70/30 and 95/5, and mixtures of methyl methacrylate, methyl acrylate, and methacrylic acid wherein the weight ratio of methyl methacrylate/methacrylic acid is between 60/40 and 95/5 and the methyl acrylate is 0 to 50% by weight of the methyl methacrylate.

The matte agent preferably has a mean particle size of more than 2 μm. A matte agent of a particle size distribution having maximum peaks at more than 3 μm and less than 3 μm is especially preferred. This is because a matte agent having a particle size of more than 3 μm controls the strippability of the photosensitive material and a matte agent having a particle size of less than 3 μm mainly controls the lubricity and luster of the photosensitive material. It is particles of more than 3 μm that usually causes precipitation of a coating solution and stripping off during processing. The invention is effective for such a matte agent of more than 3 μm.

In the photographic silver halide photosensitive material of the invention, a polyhydric alcohol is preferably used in the silver halide emulsion layer in an amount of $1.0\times10^{-3}$ to $5.0\times10^{-1}$ mol per mol of the silver halide. The preferred amount of the polyhydric alcohol added is $5.0\times10^{-2}$ to $2.0\times10^{-1}$ mol per mol of the silver halide.

The polyhydric alcohols used herein are preferably those alcohols having 2 to 12 hydroxyl groups and 2 to 20 carbon atoms in a molecule wherein two hydroxyl groups are not conjugated through a conjugated chain, that is, an oxidized form is not depictable. More preferably, the polyhydric alcohols have a melting point of 50° C. to 300° C.

Several illustrative, non-limiting, examples of the polyhydric alcohol are given below.

| No. | Compound designation | m. p. (°C.) |
|---|---|---|
| 1 | 2,3,3,4-tetramethyl-2,4-pentanediol | 76 |
| 2 | 2,2-dimethyl-1,3-propanediol | 127–128 |
| 3 | 2,2-dimethyl-1,3-pentanediol | 60–63 |
| 4 | 2,2,4-trimethyl-1,3-diol | 52 |
| 5 | 2,5-hexanediol | 43–44 |
| 6 | 2,5-dimethyl-2,5-hexanediol | 92–93 |
| 7 | 1,6-hexanediol | 42 |
| 8 | 1,8-octanediol | 60 |
| 9 | 1,9-nonanediol | 45 |

-continued

| No. | Compound designation | m. p. (°C.) |
|---|---|---|
| 10 | 1,10-decanediol | 72–74 |
| 11 | 1,11-undecanediol | 62 |
| 12 | 1,12-dodecanediol | 79 |
| 13 | 1,13-tridecanediol | 77 |
| 14 | 1,14-tetradecanediol | 83–85 |
| 15 | 1,12-octadecanediol | 66–67 |
| 16 | 1,18-octadecanediol | 96–98 |
| 17 | cis-2,5-dimethylhexene-2,5-diol | 69 |
| 18 | trans-2,5-dimethylhexene-2,5-diol | 77 |
| 19 | 2-butene-1,4-diol | 55 |
| 20 | 2,5-dimethyl-3-hexyne-2,5-diol | 95 |
| 21 | 2,4-hexadiyne-1,6-diol | 111–112 |
| 22 | 2,6-octadiyn-1,8-diol | 89 |
| 23 | 2-methyl-2,3,4-butanetriol | 49 |
| 24 | 2,3,4-hexanetriol | 47 |
| 25 | 2,4-dimethyl-2,3,4-hexanetriol | 99 |
| 26 | 2,4-dimethyl-2,3,4-pentanetriol | 75 |
| 27 | pentamethylglycerin | 116–117 |
| 28 | 2-methyl-2-oxymethyl-1,3-propanediol | 199 |
| 29 | 2-isopropyl-2-oxymethyl-1,3-propanediol | 83 |
| 30 | 2,2-dihydroxymethyl-1-butanol | 58 |
| 31 | erythrithol | 126 |
| 32 | D-tholeiite | 88 |
| 33 | L-tholeiite | 88 |
| 34 | rac-tholeiite | 72 |
| 35 | pentaerythrithol | 260–265 |
| 36 | 1,2,3,4-pentatetrole | 106 |
| 37 | 2,3,4,5-hexanetetrole | 162 |
| 38 | 2,5-dimethyl-2,3,4,5-hexanetetrole | 153–154 |
| 39 | 1,2,5,6-hexanetetrole | 95 |
| 40 | 1,3,4,5-hexanetetrole | 88 |
| 41 | 1,6-(erythro-3,4)-hexanetetrole | 121–122 |
| 42 | 3-hexene-1,2,5,6-tetrole | 80–82 |
| 43 | 3-hexyne-1,2,5,6-tetrole | 113–115 |
| 44 | adonitol | 102 |
| 45 | D-arabitol | 102 |
| 46 | L-arabitol | 102 |
| 47 | rac-arabitol | 105 |
| 48 | xylitol | 93–95 |
| 49 | L-mannitol | 164 |
| 50 | dulcitol | 189 |

In the photosensitive material of the invention, the hydrophilic colloid layer is hardened with a hardener to a swelling factor of less than 180% in water. The swelling factor in water is measured by a freeze dry method. More particularly, a photosensitive material is aged for 7 days at 25° C. and RH 60% before a hydrophilic colloid layer is measured for a swelling factor. The thickness (a) of a dry layer is determined by observing a piece thereof under a scanning electron microscope. The thickness (b) of a swollen layer is determined by immersing a piece of the photosensitive material in distilled water at 21° C. for 3 minutes, freeze drying it with liquid nitrogen, and observing it under a scanning electron microscope. The swelling factor is calculated as $(b-a)/a\times100\%$. The lower limit of swelling factor is 0% indicating no swelling. Preferably, the swelling factor is 30 to 180%.

Various additives as mentioned above are used in the photosensitive material of the invention while other various additives may be used depending on a particular purpose.

Such other additives are described in Research Disclosure, Item 17643, December 1978, ibid, Item 18716, November 1979 and ibid, Item 307105, November 1989. They are listed below together with the pages to be referred to in the literature. Letters R and L mean right and left columns of the page.

| Additive | RD17643 | RD18716 | RD307105 |
|---|---|---|---|
| 1. Chemical sensitizer | 23 | 648R | 996 |
| 2. Sensitivity increasing agent | 23 | 648R | 996 |
| 3. Spectral sensitizer/ Supersensitizer | 23–24 | 648R–649R | 996R–998R |
| 4. Brightener | 24 | | 998R |
| 5. Antifoggant/stabilizer | 24–25 | 649R | 998R–1000R |
| 6. Light absorber/filter dye/ UV absorber | 25–26 | 649R–650L | 1003L–R |
| 7. Anti-sludging agent | 25R | 650L–R | |
| 8. Dye image stabilizing agent | 25 | | |
| 9. Hardener | 26 | 651L | 1004R–1005L |
| 10. Binder | 26 | 651L | 1003R–1004R |
| 11. Plasticizer/lubricant | 27 | 650R | 1006L–R |
| 12. Coating aid/ surface activator | 26–27 | 650R | 1005L–1006L |
| 13. Antistatic agent | 27 | 650R | 1006R–1007L |

Next, the processing solutions and conditions are described.

In the practice of the invention, the processing solutions are replenished during the process. The preferred replenishment amount is 25 to 150 ml of the developer and 13 to 300 ml of the fixer both per square meter of the photo-sensitive material. The preferred replenishment amount of the developer and the fixer combined is 38 ml to 450 ml/$M^2$ of the photosensitive material. Where an overflow from the washing bath is channeled to the fixing bath, the replenishing amount of the fixer is inclusive of the amount of that overflow from the washing bath. The preferred replenishment amount of washing water is 13 to 150 ml/$m^2$ when wash water is recovered in a multi-stage washing system.

According to the invention, the developer uses an ascorbic acid type compound as a developing agent. The ascorbic acid type compound is preferably represented by the following general formula (II).

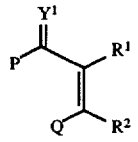

(II)

In formula (II), each of $R^1$ and $R^2$ is a hydroxyl group; amino group which may have a substituent, for example, alkyl having 1 to 10 carbon atoms such as methyl, ethyl, n-butyl and hydroxyethyl; acylamino group such as acetylamino and benzoylamino; alkylsulfonylamino group such as methanesulfonylamino; arylsulfonylamino group such as benzenesulfonylamino and p-toluenesulfonylamino; alkoxycarbonylamino group such as methoxycarbonylamino; mercapto group; or alkylthio group such as methylthio and ethylthio. Preferred groups represented by $R^1$ and $R^2$ are hydroxyl, amino, alkylsulfonylamino, and arylsulfonylamino groups.

Each of P and Q represents a hydroxy, carboxy, substituted or unsubstituted alkoxy, substituted or unsubstituted alkyl, sulfo, substituted or unsubstituted amino, or substituted or unsubstituted aryl group. Alternatively, P and Q, taken together, represent a group of atoms which form a five to eight-membered ring with the two vinyl carbon atoms having substituents $R^1$ and $R^2$ thereon and the carbon atom having a substituent yl thereon. Exemplary ring structures are combinations of —O—, —C($R^9$)($R^{10}$)—, —C($R^{11}$)=, —C(=O)—, —N($R^{12}$)—, and —N= wherein $R^9$, $R^{10}$, $R^{11}$ and $R^{12}$ each are a hydrogen atom, substituted or unsubstituted alkyl group having 1 to 10 carbon atoms (exemplary substituents being hydroxy, carboxy, and sulfo groups), hydroxyl group or carboxyl group. These five to eight-membered rings may have a saturated or unsaturated ring fused thereto.

Examples of the five to eight-membered ring include dihydrofuranone ring, dihydropyrroline ring, pyranone ring, cyclopentenone ring, cyclohexenone ring, pyrolynone ring, pyrazolinone ring, pyridone ring, azacyclohexenone ring, and uracil ring, with the dihydrofuranone, cyclopentenone, cyclohexenone, pyrazolinone, azacyclohexenone, and uracil rings being preferred.

$Y^1$ is =O or =N—$R^3$ wherein $R^3$ is a hydrogen atom, hydroxy, alkyl (e.g., methyl and ethyl), acyl (e.g., acetyl), hydroxyalkyl (e.g., hydroxymethyl and hydroxyethyl), sulfoalkyl (e.g., sulfomethyl and sulfoethyl), or carboxyalkyl (e.g., carboxymethyl and carboxyethyl).

Several illustrative examples of the ascorbic acid type compound of formula (II) are given below although the invention is not limited thereto.

A-1

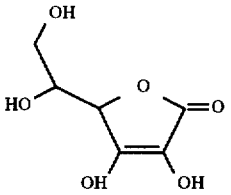

A-2

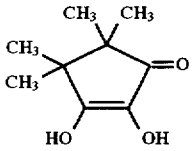

A-3

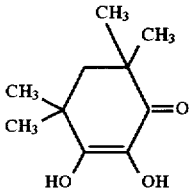

A-4

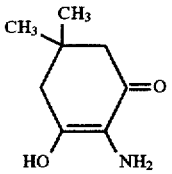

A-5

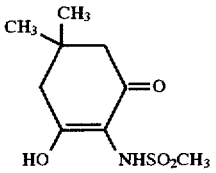

A-6

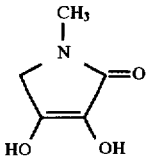

-continued

A-7

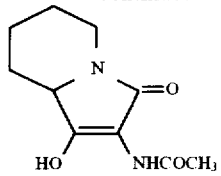

A-8

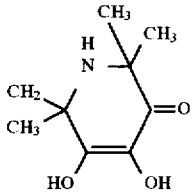

A-9

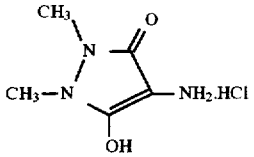

A-10

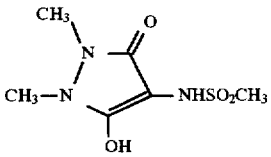

A-11

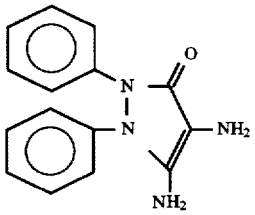

A-12

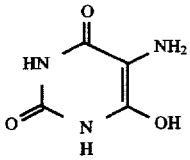

A-13

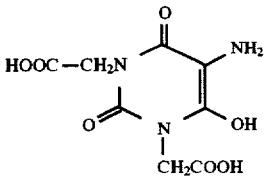

A-14

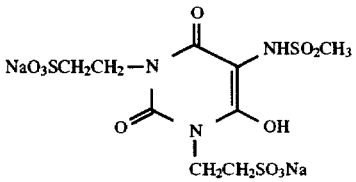

A-15

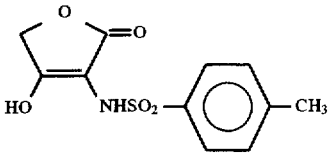

-continued

A-16

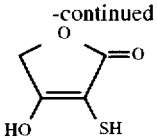

A-17

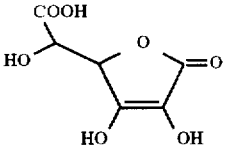

A-18

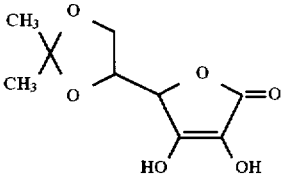

A-19

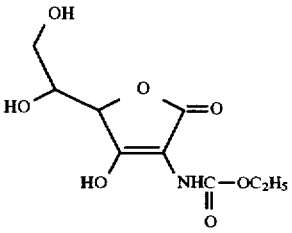

A-20

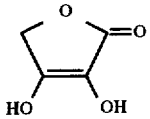

A-21

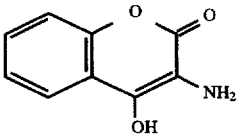

A-22

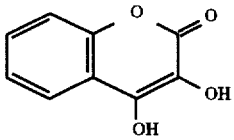

A-23

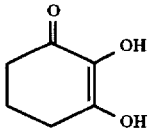

A-24

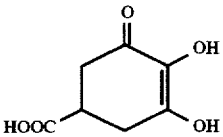

Preferred among these are ascorbic acid and erythorbic acid (which is a diastereomer of ascorbic acid) as well as lithium, sodium and potassium salts thereof.

The ascorbic acid type compound is used in the developer as a developing agent, preferably in amounts of 0.01 to 0.8 mol/liter, more preferably 0.1 to 0.4 mol/liter.

In the developer according to the invention, an auxiliary developing agent having superadditivity is preferably used in admixture with the ascorbic acid developing agent. The auxiliary developing agent exhibiting superadditivity includes 1-phenyl-3-pyrazolidones and p-aminophenols.

Non-limiting examples of the 1-phenyl-3-pyrazolidone used herein as the auxiliary developing agent include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone, with the 1-phenyl-4-methyl-4-hydroxymethyl-3-pyrazolidone being preferred.

Non-limiting examples of the p-aminophenol used herein as the auxiliary developing agent include N-methyl-p-aminophenol, N-(β-hydroxyethyl)-p-aminophenol, N-(4-hydroxyphenyl)glycine, 2-methyl-p-aminophenol, p-benzylaminophenol, with the N-methyl-p-aminophenol being preferred.

Where 1-phenyl-3-pyrazolidones and p-aminophenols are used as an auxiliary developing agent in combination with the ascorbic acid developing agent, it is preferred to use 0.01 to 0.5 mol/liter of the developing agent and 0.001 to 0.1 mol/liter of the auxiliary developing agent, especially 0.005 to 0.05 mol/liter of the auxiliary developing agent.

The developer of the invention is substantially free of polyhydroxybenzene compounds as typified by dihydroxybenzenes such as hydroquinone. The term substantially free means that the relevant compound is less than 0.0001 mol/liter, most preferably the relevant compound is not contained at all.

In the developer of the invention, an amino compound may be contained for promoting development. Useful amino compounds are described in JP-A 106244/1981, 267759/1986 and 208652/1990.

The developer used herein is at pH 8.0 to 13.0, preferably pH 8.3 to 12, more preferably pH 8.5 to 10.5.

Alkaline agents are used to adjust the pH of the developer to the above range. Water-soluble inorganic alkali metal salts such as sodium hydroxide and sodium carbonate are typically used. The developer according to the invention may further contain pH buffers such as disodium hydrogenphosphate, dipotassium hydrogenphosphate and sodium dihydrogenphosphate and potassium dihydrogenphosphate and other pH buffers as described in JP-A 93433/1985. For the pH adjustment of the developer, the alkaline agent or pH buffer is preferably used in an amount of at least 0.3 mol/liter, more preferably 0.4 to 1 mol/liter, in the developer wherein an ascorbic acid type compound is contained as the developing agent, boron compounds such as boric acid and sodium metaborate should be avoided because they can react with and deactivate the ascorbic acid type compounds.

In the developer according to the invention, an anti-silver-sludging agent may be used, for example, compounds as described in JP-B 4702/1987, 4703/1987, JP-A 200249/1989, 303179/1993 and 53257/1993.

In addition to the amino compound, alkaline agent and anti-sludging agent mentioned above, the developer according to the invention may further contain a development retarder such as potassium bromide and potassium iodide, an organic solvent such as dimethylformamide, methyl cellosolve, ethylene glycol, ethanol and methanol, and an antifoggant such as 5-methylbenzotriazole, 5-chlorobenzotriazole, 5-bromobenzotriazole, 5-butylbenzotriazole, and benzotriazole.

Furthermore, a preservative may be used in the developer according to the invention. Typical are sulfite preservatives such as sodium sulfite, potassium sulfite, lithium sulfite, ammonium sulfite, sodium bisulfite, and potassium metabisulfite. The sulfite is preferably used in amounts of at least 0.01 mol/liter, especially 0.02 to 2.5 mol/liter. Other useful preservatives are described in L. F. A. Mason, Photographic Processing Chemistry, Focal Press, 1966, pp. 226–229, U.S. Pat. Nos. 2,193,015, 2,592,364 and JP-A 64933/1973.

Further, toners, surfactants, water softeners, and film hardeners are contained in the developer according to the invention, if desired.

Chelating agents which can be contained in the developer include ethylenediamine diorthohydroxyphenylacetic acid, diaminopropane tetraacetic acid, nitrilotriacetic acid, hydroxyethyl ethylenediamine triacetic acid, dihydroxyethyl glycine, ethylenediamine diacetic acid, ethylenediamine dipropionic acid, iminodiacetic acid, diethylenetriamine pentaacetic acid, hydroxyethyliminodiacetic acid, 1,3-diaminopropanol tetraacetic acid, triethylenetetramine hexaacetic acid, transcyclohexanediamine tetraacetic acid, ethylenediamine tetraacetic acid, glycol ether diamine tetraacetic acid, ethylene diamine tetrakismethylenephosphonic acid, diethylenetriamine-pentamethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,3,3-tricarboxylic acid, catechol-3,4-disulfonic acid, sodium pyrophosphate, sodium tetrapolyphosphate, and sodium hexametaphosphate. Especially preferred are diethylenetriamine pentaacetic acid, triethylenetetramine hexaacetic acid, 1,3-diaminopropanol tetraacetic acid, glycol ether diamine tetraacetic acid, hydroxyethyl ethylenediamine triacetic acid, 2-phosphonobutane-1,2,4-tricarboxylic acid, 1,1-diphosphonoethane-2-carboxylic acid, nitrilotrimethylenephosphonic acid, ethylenediaminetetrakismethylenephosphonic acid, diethylenetriaminepentamethylenephosphonic acid, 1-hydroxypropylidene-1,1-diphosphonic acid, 1-aminoethylidene-1,1-diphosphonic acid, and 1-hydroxy-ethylidene-1,1-diphosphonic acid and salts thereof.

Of all the cations contained in the developer according to the invention, it is preferred that a potassium ion accounts for 10 to 90 mol % and a sodium ion accounts for 10 to 90 mol %. More preferably, a potassium ion accounts for 20 to 50 mol % and a sodium ion accounts for 50 to 80 mol %.

The developer of the invention can take the form of a concentrate for the purpose of reducing the cost of transportation and the space for storage. The concentrate should preferably have a concentration factor of 3 or less, more preferably 2 or less, for the purpose of preventing developer components from precipitating at low temperatures. For storage, components having different solubilities may be divided into several parts which are to be mixed and diluted on use. Most preferably, the developer of the invention is in the form of a one-part twice concentrated liquid.

With respect to replenishment of the developer of the invention, a dilute developer is preferably replenished in an amount of less than 150 ml, more preferably 150 to 25 ml, further preferably 150 to 30 ml, most preferably 150 to 60 ml per square meter of the photosensitive material.

In the development step according to the invention, the preferred developing conditions include a temperature of 20° C. to 50° C. and a time of 5 to 60 seconds, more preferably 25° to 40° C. and 5 to 30 seconds, most preferably 32° to 38° C. and 15 to 30 seconds.

Next, the fixer used in the practice of the invention is described.

The fixer used herein is preferably an aqueous solution containing a thiosulfate as a fixing agent. Exemplary thiosulfates are sodium thiosulfate (hypo) and ammonium thiosulfate. Sodium thiosulfate is preferred when the environmental problem is taken into account.

The thiosulfate may be used in any suitable amount although it is generally used in amounts of about 0.1 to 5 mol/liter.

If desired, the fixer contains film hardeners (e.g., water-soluble aluminum compounds such as aluminum chloride, aluminum sulfate and potassium alum), preservatives (e.g., sulfites and bisulfites), pH buffers (e.g., acetic acid and boric acid), pH adjusting agents (e.g., ammonia and sulfuric acid), chelating agents, surfactants (e.g., anionic surfactants such as sulfonates, polyethylene surfactants, and ampholytic surfactants as described in JP-A 6804/1982), humectants (e.g., alkanolamines and alkylene glycols), fixation promoters (e.g., thiourea derivatives as described in JP-B 35754/1970, 122535/1983, and 122536/1983, alcohols having a triple bond in a molecule, thioether compounds as described in U.S. Pat. No. 4,126,459, and mesoionic compounds as described in JP-A 143755/1992, 143756/1992, 143757/1992 and 170539/1992. In addition to the above-mentioned compounds, the fixer may further contain tartaric acid, citric acid, gluconic acid and derivatives thereof, alone or in admixture of two or more.

The fixer is at pH 3 or higher, preferably pH 4.2 to 6.3.

In the fixation step according to the invention, the preferred fixing conditions include a temperature of 20° C. to 50° C. and a time of 5 to 60 seconds, more preferably 25° to 40° C. and 10 to 40 seconds.

The fixer of the invention can take the form of a concentrate for the purpose of reducing the cost of transportation and the space for storage. The concentrate should preferably have a concentration factor of 3 or less, more preferably 2 or less, for the purpose of preventing fixer components from precipitating at low temperatures. For storage, components having different solubilities may be divided into several parts which are to be mixed and diluted on use. Most preferably, the fixer of the invention is in the form of a one-part twice concentrated liquid.

With respect to replenishment of the fixer of the invention, a dilute fixer is preferably replenished in an amount of less than 300 ml, more preferably 300 to 13 ml, further preferably 300 to 20 ml, most preferably 300 to 30 ml per square meter of the photosensitive material. Where an overflow of the washing bath is channeled to the fixing bath, the replenishment amount of the fixer is inclusive of that overflow.

In one embodiment of the invention wherein the developer and the fixer are a developer concentrate and a fixer concentrate, respectively, the concentrates are diluted for use as a replenisher or tank solution. One dilution mode is by previously diluting developer and fixer concentrates and charging developing and fixing tanks with a dilute developer and a dilute fixer, respectively. In a more preferred mode (known as direct mixing dilution mode), a developer concentrate and a fixer concentrate are diluted with water in respective tanks to form ready-to-use solutions which are supplied as the replenisher.

Where the automatic processor includes cartridges containing a developer stock and a fixer stock and chemical mixers, they are preferably designed such that the cartridges may be emptied of the developer and fixer stocks at the same time.

According to the processing method of the invention, the photosensitive material which has been developed and fixed is treated with washing water or stabilizing solution and then dried.

Washing water is preferably passed through a filter member or filter layer of activated carbon for removing foreign matter and organic matter before it is supplied into the washing tank.

Where washing is performed with a small amount of water, it is preferred to provide the processor with a squeeze roller washing tank as described in JP-A 18350/1988. A water washing arrangement as described in JP-A 143548/1988 is also preferred. When water is replenished to a washing or stabilizing bath through antibacterial means, a part or the entirety of water overflowing from the washing or stabilizing bath can be utilized in a preceding step to form a part of a processing solution having a fixing function as described in JP-A 235133/1985. Known means for reducing the replenishment amount of washing water is a multi-stage counterflow system (typically two or three stages). The multi-stage counterflow system ensures more efficient water washing because the photosensitive material after fixation is gradually processed in a cleaner direction. For such water saving or pipeless treatment, anti-bacterial means is preferably applied to washing water or stabilizer solution.

The known anti-bacterial means includes irradiation of ultraviolet radiation as disclosed in JP-A 263939/1985; application of a magnetic field as disclosed in JP-A 263940/1985; the use of ion-exchange resins to purify water as disclosed in JP-A 131632/1986; blowing of ozone and circulation through a filter and adsorbent column as described in JP-A 151143/1992; bacterial decomposition as described in JP-A 240636/1992; and anti-bacterial agents as disclosed in JP-A 115154/1987, 153952/1987, 220951/1987 and 209532/1987. Also useful are anti-fungal agents, anti-bacterial agents and surfactants as described in M. W. Beach, "Microbiological Growths in Motion-Picture Processing", SMPTE Journal, Vol. 85 (1976); R. O. Deegan, "Photo Processing Wash Water Biocides", J. Imaging Tech., 10, No. 6 (1984); and JP-A 8542/1982, 58143/1982, 97530/1982, 132146/1982, 257244/1982, 18631/1983, and 105145/1983.

In the washing or stabilizing bath, there may be optionally added as a microbiocide the isothiazolines described in R. T. Kreiman, J. Image, Tech 10 (6), 242 (1984), bromochlorodimethylhydantoin, the isothiazolines described in Research Disclosure, Vol. 205, No. 20526 (May 1981) and Vol. 228, No. 22845 (April 1983), and the compounds described in JP-A 209532/1987. Other useful compounds are described in HORIGUCHI Hiroshi, "Bokin Bobai no Kagaku (Antibacterial and Antifungal Chemistry)", Sankyo Publishing K.K., 1982, and Nippon Bokin Bobai Society, "Bokin Bobai Gijutu Handbook (Antibacterial & Antifungal Engineering Handbook)", Hakuhodo K.K., 1986.

In the processor used herein, the washing tank is preferably provided at an outlet port with an electro-magnetic valve as anti-slime means.

After development, fixation, and water washing (or stabilization), the photosensitive material is passed between squeeze rollers for squeezing off washing water and then dried. Drying is done at a temperature of about 40° to 100° C. The drying time is variable depending on various conditions although a time of about 1 second to about 3 minutes is commonly used. Drying is preferably done at 40° to 80° C. for about 5 seconds to about 2 minutes. Drying is preferably done using a heating roller at a surface temperature of 60° to 120° C., more preferably 70° to 100° C., with the preferred drying time being about 1 to 30 seconds.

The automatic processor used herein may be of the roller conveyor or belt conveyor system. An automatic processor of the roller conveyor type is preferred. An automatic processor including a developing tank having a reduced aperture (which is an area of the surface of the developing solution in contact with air in the developing tank per tank volume) of up to 0.04, more preferably up to 0.03, most preferably up to 0.025 as disclosed in JP-A 193853/1989 is especially preferred because air oxidation and evaporation are minimized and the replenishment amount is reduced. In such a processor, photosensitive material is passed between squeeze rollers for squeezing off washing water before drying.

In the photosensitive material processing system of the invention, the overall processing time from the entry into the developer to the exit from the drying step (that is, dry-to-dry processing time) is preferably 80 seconds or shorter, more preferably 50 seconds or shorter. The overall processing time is preferably 15 to 80 seconds, more preferably 20 to 50 seconds, especially 25 to 47 seconds. Various modifications are made to the process in order to accomplish such rapid processing, for example, the use of rubbery material rollers in the developing tank as outlet rollers to prevent uneven development inherent to rapid processing as described in JP-A 151943/1988; a developer jet flow in the developing tank at a flow speed of at least 10 m/min. for agitating the developer therein as described in JP-A 151944/1988; and more rigorous agitation during development than in standby periods as described in JP-A 264758/1988. Further for the rapid processing, the fixing tank is provided with an arrangement of opposed rollers for increasing a fixation rate. The opposed roller arrangement is effective for reducing the number of rollers and the size of the fixing tank, that is, making the processor more compact.

Preferably the tanks of the automatic processor according to the invention including developer, fixer and wash water tanks have a volume (or bath solution volume) of less than 8.0 liters. A processor can accommodate for rapid and mass scale processing by increasing the tank volume and the number of rollers for enhancing the effect of development, fixation and washing although the processor becomes large sized and requires a careful choice of its installation site. The processor can be reduced in size at the sacrifice of processing throughput and also at the sacrifice of stable processing because solutions become likely to be oxidized and deteriorated. We have found that an optimum tank volume is 8.0 liters or less, especially 4.0 to 8.0 liters when an hourly processing throughput of at least 300 sheets of the quarter-size (10×12 inches) is set. The throughput is preferably 300 to 800 sheets of the quarter-size/hour, more preferably 300 to 500 sheets of the quarter-size/hour.

The total amount of spent solution is the total of replenishment amounts of processing solution minus the carry-over by the photosensitive material.

The automatic processor according to the invention which is of relatively small size may be provided with a duct for discharging stenchful vapor or may not be provided with such a duct in a substantial sense. Pipes for discharging spent ones of the developer and fixer and pipes for replenishing wash water or stabilizer solution and discharging spent water may be provided although such pipes are substantially unnecessary. Then the processor can be installed in a simple manner.

The processor is removably loaded with flexible containers for replenishers. The containers preferably have an oxygen permeability of less than 50 ml/m$^2$.atm.day at a temperature of 20° C. and a relative humidity of 60%. The containers are preferably made of a suitable material to a wall gage of less than 500 μm, more preferably less than 250 μm, most preferably 70 to 150 μm although a wall gage of more than 1 mm is acceptable. The flexible material is defined as follows. A film strip of 20 cm×2 cm is formed from a material and rested on a horizontal table. The film strip is extended 10 cm from the table edge so that the strip end sags. When the sagging end of the strip is spaced downward a vertical distance of at least 2 cm, preferably at least 3 cm, more preferably at least 5 cm from the horizontal plane of the table, this material is defined as being flexible.

Examples of the flexible material having an oxygen permeability of less than 50 ml/m$^2$.atm.day at 20° C. and RH 60% include cellophane, polyethylene, polyester, polyvinyl chloride, polyvinylidene chloride, polypropylene, nylon, aluminum foil laminate film, metallized film (e.g., aluminum), and silica evaporated film. Plastic materials comprising at least one of saponified ethylene-vinyl acetate copolymers and nylon and having an oxygen permeability of less than 50 ml/m$^2$.atm.day at 20° C. and RH 60%, preferably less than 25 ml/m$^2$.atm.day at 20° C. and RH 60% are preferred because they can be readily worked into containers having satisfactory strength.

When the developer is contained in a container of such plastic material for storage, the developer can maintain its photographic characteristics stable over a long period of storage.

With respect to the measurement of oxygen permeability, the method described in N. J. Calvano, 2 permeation of plastic container, Modern Packing, December 1986, pp. 143–145 is used.

When replenisher containers are made of plastic materials comprising at least one of saponified ethylene-vinyl acetate copolymers (trade name Eval) and nylon and having an oxygen permeability of less than 50 ml/m$^2$.atm.day at 20° C. and RH 60%, a film of a single plastic material or a composite film comprising a support and one or more films attached thereto may be used.

The replenisher containers made of plastic material may have a shape of cubic type or laminate pillow type. The pillow type is advantageous in that the replenisher container can be deformed to a substantially zero volume when it is emptied of the replenisher.

In the preferred embodiment, the photosensitive material of the invention is combined with a fluorescent screen to form an image. The fluorescent screen is described below. Since the photosensitive material of the invention has a high silver chloride emulsion, it is preferred to use a screen having a maximum light emission wavelength of longer than 500 nm or a screen having a maximum light emission wavelength of shorter than 350 nm. Such screens can increase the spectral sensitivity of the photosensitive material, yielding a high sensitivity system.

In the first place, the screen having a maximum light emission wavelength of longer than 500 nm is described. Such a radiation intensifying screen has a maximum light emission wavelength of longer than 500 nm, usually 500 to 600 nm and in a basic structure, is comprised of a support and a fluorescent layer formed on one surface thereof. The fluorescent layer is a layer having a fluorescent substance dispersed in a binder. Usually a transparent protective film is formed on the surface of the fluorescent layer remote from the support for protecting the fluorescent layer from chemical degradation or physical shocks.

A number of fluorescent substances are known for use in radiation intensifying screens. The fluorescent substances which are preferred in the practice of the invention are of the following general formula:

$$M_2O_2X:Tb$$

wherein M is at least one metal of yttrium, gadolinium and lutetium, and X is a chalcogen such as sulfur, selenium and tellurium. Illustrative examples of the radiation intensifying fluorescent substance which is preferably used in the radiation intensifying screen include terbium-activated rare earth sulfate compound fluorescent substances such as $Y_2O_2S$:Tb, $Gd_2O_2S$:Tb, $La_2O_2S$:Tb, $(Y,Gd)_2O_2S$:Tb, and $(Y,Gd)_{22}O_2S$:Tb,Tm. Note that the terbium-activated gadolinium oxysulfide fluorescent substances are described in U.S. Pat. No. 3,725,704. The fluorescent substancewhich is most preferred for use in the invention is of the compositional formula: $Gd_2O_2S$:Tb.

The fluorescent layer is generally attached to the support by a coating method under atmospheric pressure as will be described below. More particularly, fluorescent particles and a binder are mixed and dispersed in a suitable solvent to form a coating solution. The coating solution is directly applied onto a support of a radiation intensifying-screen under atmospheric pressure by such coating means as a doctor blade, roll coater, and knife coater. The solvent is then evaporated off from the coating. Alternatively, the coating solution is previously applied onto a temporary support such as a glass plate under atmospheric pressure, and the solvent is evaporated off from the coating to leave a fluorescent substance-containing resin film. The film is peeled from the temporary support, and bonded to a support of a radiation intensifying screen. In this way, the fluorescent layer is attached to the support.

Preferably, the radiation intensifying screen is prepared by using a thermoplastic elastomer (to be described later) as a binder and effecting compression treatment to increase the percent packing of the fluorescent substance (or to reduce the voids of the fluorescent layer). By such a method, a radiation intensifying screen having a fluorescent substance packing of more than 68% by volume can be readily obtained. By further optimizing the particle size distribution of the fluorescent substance, a radiation intensifying screen having a fluorescent substance packing of more than 72% by volume can be obtained.

The sensitivity of the radiation intensifying screen generally depends on the overall light emission of the fluorescent substance contained therein, which not only depends on the light emission luminance of the fluorescent substance itself, but also varies with the content of the fluorescent substance in the fluorescent layer. With a greater content of the fluorescent substance, which also means a greater absorption of radiation such as X-ray, a higher sensitivity is obtained and an improvement in image quality (especially graininess) is accomplished at the same time. On the other hand, for a fixed fluorescent substance content of the fluorescent layer, a more dense packing of fluorescent particles allows the fluorescent layer to be thinner so that the spreading of emission light by scattering may be minimized to provide a relatively high sharpness.

The radiation intensifying screen is preferably prepared by a method involving step (a) of forming a fluorescent sheet comprising a fluorescent substance and a binder, and step (b) of pressing the fluorescent sheet to a support at a temperature above the softening or melting point of the binder, thereby bonding the fluorescent sheet to the support.

Step (a) is first described. The fluorescent sheet which forms a fluorescent layer of the radiation intensifying screen is obtained by applying a coating solution of the fluorescent substance uniformly dispersed in a binder solution onto a temporary support for fluorescent sheet formation, drying the coating, and peeling the coating from the temporary support.

More particularly, the binder and fluorescent particles are first added to a suitable organic solvent. The mixture is agitated until the fluorescent particles are uniformly dispersed in the binder solution to form a coating solution.

The binder used herein is a thermoplastic elastomer having a softening or melting point of 30° to 150° C. alone or in admixture with another binder polymer. Since the thermoplastic elastomer is elastic at room temperature and becomes fluid when heated, it prevents failure of the fluorescent substance by pressure subsequently applied for compression. Examples of the thermoplastic elastomer include polystyrene, polyolefin, polyurethane, polyester, polyamide, polybutadiene, ethylene-vinyl acetate, polyvinyl chloride, natural rubber, fluorine rubber, polyisoprene, chlorinated polyethylene, styrene-butadiene rubber, and silicone rubber.

Of the binder, the thermoplastic elastomer should preferably account for 10 to 100% by weight. The binder is preferably composed of a higher percentage of the thermoplastic elastomer, especially 100% by weight of the thermoplastic elastomer.

Examples of the solvent used to prepare the coating solution include lower alcohols such as methanol, ethanol, n-propanol and n-butanol; chlorine atom-containing hydrocarbons such as methylene chloride and ethylene chloride; ketones such as acetone, methyl ethyl ketone, and methyl isobutyl ketone; esters of a lower fatty acid with a lower alcohol such as ethyl acetate and butyl acetate; ethers such as dioxane, ethylene glycol monoethyl ether and ethylene glycol monomethyl ether; and mixtures thereof.

In the coating solution, the mixing ratio of the binder to the fluorescent substance varies with the characteristics of an intended radiation intensifying screen and the type of fluorescent substance although the ratio is usually in the range between 1:1 and 1:100, preferably between 1:8 and 1:40, more preferably between 1:15 and 1:40 by weight.

It is noted that various additives may be contained in the coating solution. For example, there may be mixed a dispersant for improving the dispersion of the fluorescent substance in the coating solution and a plasticizer for improving the bond force between the binder and the fluorescent substance in the fluorescent layer formed therefrom. Examples of the dispersant used for such a purpose include phthalic acid, stearic acid, caproic acid and oleophilic surfactants. Examples of the plasticizer include phosphoric acid esters such as triphenyl phosphate, tricresyl phosphate, and diphenyl phosphate; phthalic acid esters such as diethyl phthalate and dimethoxyethyl phthalate; glycolic acid esters such as ethylphthalylethyl glycolate and butylphthalylbutyl glycolate; and polyesters of a polyethylene glycol with an aliphatic dibasic acid such as a polyester of triethylene glycol with adipic acid and a polyester of diethylene glycol with succinic acid.

The thus prepared coating solution containing the fluorescent substance and the binder is then uniformly applied to a surface of a temporary support for sheet formation to form a coating. This application may be done by conventional coating means such as a doctor blade, roll coater and knife coater.

The temporary support may be selected from glass plates, metal plates, and materials well known as the support of the radiation intensifying screen. Exemplary such materials include films of plastic materials such as cellulose acetate, polyester, polyethylene terephthalate, polyamide, and triacetate; metal sheets such as aluminum foil and aluminum alloy foil; plates or sheets of ceramic materials such as alumina, zirconia, magnesia, and titania.

After the coating solution for fluorescent layer formation is applied onto the temporary support and dried, the coating is peeled from the support, obtaining a fluorescent sheet which will form the fluorescent layer of the radiation intensifying screen. Therefore, the temporary support is preferably pre-coated on the surface with a release agent so that the fluorescent sheet may be readily peeled from the support.

Next, step (b) is described. A support is furnished which is to bear the above-prepared fluorescent sheet. The support may be selected from the same material as used for the temporary support for fluorescent sheet formation. Supports of $TiO_2$-loaded polyethylene terephthalate or carbon black-loaded polyethylene terephthalate are especially preferred while their gage is preferably from 150 to 400 μm.

In prior art radiation intensifying screens, it is known that the fluorescent layer-bearing surface of the support is provided with an adhesive layer by coating a polymer such as gelatin, a light reflecting layer of light reflecting material such as titanium dioxide or a light absorbing layer of light absorbing material such as carbon black for the purpose of enhancing the bond between the support and the fluorescent layer or improving the sensitivity or image quality (sharpness and graininess) of the radiation intensifying screen. The support used in the invention may also be provided with such layers, and the construction of such layers may be properly selected depending on the desired purpose and application of the radiation intensifying screen.

For the light reflecting layer, $TiO_2$ particles having a particle size of 0.1 to 0.3 μm are preferably used in a high packing density. A layer with a packing density of 30 to 50% by volume and a gage of about 40 μm is preferred. Such a reflecting layer achieves a diffusion reflectivity of at least 90%, more preferably at least 95%, greatly contributing to an improvement in screen performance.

The fluorescent sheet obtained in step (a) is rested on the support. Then the fluorescent sheet is pressed to the support at a temperature above the softening or melting point of the binder, thereby bonding the fluorescent sheet to the support.

By compressing the fluorescent sheet to the support rather than previously securing the fluorescent sheet to the support, the fluorescent sheet can be thinly spread to prevent damage to the fluorescent substance and to achieve a higher fluorescent substance packing than the method of compressing the once secured sheet under the same pressure. The compression means used for compression in the practice of the invention include well-known ones such as calender rolls and hot presses. Compression by a calender roll, for example, is carried out by resting the fluorescent sheet resulting from step (a) on a support, and passing them through rollers heated above the softening or melting point of the binder at a constant rate. The compression means used herein is not limited to the above-described ones. Any compression means can be used as long as the fluorescent sheet can be compressed while heating. The compression pressure is preferably more than 50 kgw/cm$^2$.

In this way, the fluorescent layer is formed to any desired thickness, preferably in the range of 50 to 500 μm, more preferably 60 to 300 μm.

In a medical direct radiographic system using a set of two radiation intensifying screens, the front screen and the back screen may be different in thickness. The front screen preferably has a thickness of 60 to 140 μm, more preferably 70 to 120 μm. The back screen preferably has a thickness of 70 to 300 μm, more preferably 100 to 250 μm although the thickness varies with a desired system sensitivity.

A transparent protective film is formed on the thus obtained fluorescent layer. The transparent protective film may be formed by coating a solution of a transparent polymer in a suitable solvent to the surface of the fluorescent layer. Examples of the transparent polymer include cellulose derivatives such as cellulose acetate and nitrocellulose; and synthetic polymers such as polymethyl methacrylate, polyvinyl butyral, polyvinyl formal, polycarbonate, polyvinyl acetate, and vinyl chloride-vinyl acetate copolymers. Alternatively, a separate transparent film formed from polyethylene terephthalate, polyethylene naphthalate, polyethylene, vinylidene chloride and polyamide may be bonded to the surface of the fluorescent layer with a suitable adhesive. The thus formed transparent protective film preferably has a thickness of about 3 to 20 μm. A biaxially oriented polyethylene terephthalate film having a thickness of less than 7 μm and an oriented polyethylene naphthalate film having a thickness of less than 5 μm are especially preferred.

Fluoro-resins soluble in organic solvents may also be used as the protective film. A fluoro-resin film performs well when it is 2 to 5 μm thick. A film formed by coating a fluoro-resin may have been crosslinked. The protective film of fluoro-resin has the advantage that when another material or X-ray film is brought in contact with the protective film, contaminants like the plasticizer bleeding out from the other material or X-ray film do not readily penetrate into the protective film and thus, stains can be readily removed as by wiping. Such a fluoro-resin is commercially available under the trade name "Lumiflon" from Asahi Glass K.K.

Also preferably the protective film of the intensifying screen according to the invention is formed of a coating containing either one or both of a polysiloxane skeleton-bearing oligomer and a perfluoroalkyl group-bearing oligomer. The polysiloxane skeleton-bearing oligomer is one bearing a dimethylpolysiloxane skeleton, for example, desirably having at least one functional group (e.g., hydroxyl group). Also preferably this oligomer has a weight average molecular weight of 500 to 100,000, more preferably 1,000 to 100,000, most preferably 3,000 to 10,000. The oligomer bearing a perfluoroalkyl group such as a tetrafluoroethylene group is desirably one having at least one functional group (e.g., hydroxyl group: —OH) in a molecule. Also preferably this oligomer has a weight average molecular weight of 500 to 100,000, more preferably 1,000 to 100,000, most preferably 10,000 to 100,000. Since crosslinking reaction occurs between an oligomer having a functional group and another protective film-forming resin upon formation of the protective film, the oligomer is incorporated into the molecular structure of the protective film-forming resin. Then the oligomer is not removed from the protective film by long-term repetitive use of the radiation image conversion panel and cleaning of the protective film surface. The additive effect of the oligomer lasts long. For this reason, the use of an oligomer having a functional group is advantageous.

Preferably the oligomer is contained in the protective film in an amount of 0.01 to 10% by weight, especially 0.1 to 2% by weight.

Further preferably, a conductive material serving as an antistatic agent is contained in any of the layers. Examples of the conductive material used as an antistatic agent include solid conductive materials in the form of particles (e.g., spherical particles) and whiskers or fibers formed of metals oxides such as oxides of Zn, Ti, Sn, In, Si, Mo and W, composite metal oxides composed of two or more of these metal oxides, and these metal oxides doped with a hetero atom such as Al, In, Nb, Ta, Sn and halogen atom. Of these conductive materials, single crystal fibers or whiskers of K O-n$TiO_2$ (wherein n is an integer of 1 to 8) surface treated with at least one of C, ZnO, $SnO_2$, $InO_2$, and mixed crystals of $Sno_2$ and $InO_2$ are preferred for antistatic properties. Conductive zinc oxide whiskers sterically spreading like a tetrapod are also preferred as the conductive material because they have excellent antistatic properties and little affect the strength of a coated film containing them.

The conductive material can be introduced into any desired layer, preferably the surface protective layer. The conductive material is preferably added in such amounts that the weight ratio of conductive material to binder (of the relevant layer) may range from 4/1 to 1/3.

It is also preferred to introduce a conductive material on the back surface of the support, between the support and the fluorescent layer, or between the fluorescent layer and the protective layer. In this case, the conductive material is mixed with the binder in a weight ratio of from 4/1 to 1/3 and the mixture is applied to the support or protective layer to form a layer. In one preferred embodiment, the conductive material is mixed with the binder and applied on the support to form an independent undercoat layer (antistatic layer) between the support and the fluorescent layer. The conductive material is preferably mixed in such amounts that the undercoat layer may have a surface resistivity of less than $10^{12}$ Ω.

If desired and often preferably, an organic antistatic agent such as a polyethylene oxide surfactant is introduced into the surface protective layer alone or in combination with the metal oxide conductive material.

Also preferably a matte agent such as silica and polymethyl methacrylate (PMMA) is added to the surface protective layer. The matte agent should preferably have a particle size of 4 to 20 μm.

In the second place, the UV screen having a maximum light emission wavelength of shorter than 350 nm is described. According to the invention, an image can be formed by combining the photosensitive material of the invention with a fluorescent substance having a major peak at a wavelength of shorter than 350 nm. The screen having a major light emission peak at shorter than 350 nm may be selected from the screens described in JP-A 11804/1994 and WO 93/01521 though not limited thereto.

The fluorescent substance preferably has a light emission wavelength of shorter than 350 nm, more preferably 300 to 350 nm. Typical fluorescent substances include M' phase $YTaO_4$ alone or such compounds having Gd, Bi, Pb, Ce, Se, Al, Rb, Ca, Cr, Cd or Nb added thereto, LaOBr compounds having Gd, Tm, Gd and Tm, Gd and Ce, or Tb added thereto, HfZr oxides alone or such compounds having Ge, Ti or alkali metal added thereto, $Y_2O_3$ alone or such compounds having Gd or Eu added thereto, $Y_2O_2S$ having Gd added thereto, and various fluorescent substances having Gd, Tl or Ce added to the matrix as an activator. Especially preferred are M' phase $YTaO_4$ alone or such compounds having Gd or Sr added thereto, LaOBr compounds having Gd, Tm, or Gd and Tm added thereto, and HfZr oxides alone or such compounds having Ge, Ti or alkali metal added thereto.

The fluorescent substance may have a particle size of 1 to 20 μm although the particle size varies with the desired sensitivity and preparation parameters. The amount of the fluorescent substance coated is preferably 400 to 2,000 g/m$^2$ although it varies with the desired sensitivity and image quality. Within a single intensifying screen, there may be a particle size distribution graded from near the support toward the outer surface. In most cases, larger particles are on the surface. Preferably the fluorescent substance is packed to a density of at least 40%, more preferably at least 60% by volume of the fluorescent layer.

When an image is formed in the photosensitive material with a fluorescent layer disposed on either surface thereof, the amount of the fluorescent substance coated on the X-ray incident side may be different from the amount of the fluorescent substance coated on the opposite side. It is generally known that with the shielding by the intensifying screen on the X-ray incident side taken into account, the fluorescent substance buildup on the intensifying screen on the X-ray incident side is reduced when a high sensitivity system is required.

The support used in the screen may be paper, metal plates or polymer sheets. Flexible sheets of polyethylene terephthalate etc. are typically used. A light reflecting or absorbing agent may be added to the support or formed as a separate layer on the support if desired. Also if desired, the support may be provided with fine irregularities on its surface, an adhesive layer for enhancing adhesion to the fluorescent layer, or a conductive layer as an undercoat. Exemplary reflective agents include zinc oxide, titanium oxide, and barium sulfate although titanium oxide and barium sulfate are preferred because the fluorescent substance has a short emission wavelength. The reflective agent may be contained not only in the support or between the support and the fluorescent layer, but also in the fluorescent layer. Where the reflective agent is contained in the fluorescent layer, it is preferably localized near the support.

The binder used in the screen according to the invention includes natural polymers, for example, proteins such as gelatin, polysaccharides such as dextran and corn starch, and gum arabic; synthetic polymers such as polyvinyl butyral, polyvinyl acetate, polyurethane, polyalkyl acrylates, vinylidene chloride, nitrocellulose, fluorinated polymers, and polyesters as well as mixtures and copolymers thereof. The preferred binders should be highly transmissive to light emission from the fluorescent substance. In this regard, gelatin, corn starch, acrylic polymers, fluorinated olefin polymers, copolymers containing fluorinated olefin, and styrene/acrylonitrile copolymers are preferred. These binders may have a functional group which can be crosslinked with a crosslinking agent. Depending on the desired image quality, an absorber for light emission from the fluorescent substance may be added to the binder or a low transmittance binder may be used. Exemplary absorbers include pigments, dyestuffs and UV absorbers. The ratio of the fluorescent substance to the binder is usually from 1:5 to 50:1, preferably from 1:1 to 5:1 by volume. The fluorescent substance/binder ratio may be uniform or non-uniform in a thickness direction.

The fluorescent layer is generally formed by dispersing the fluorescent substance in a binder solution to form a coating solution and applying the coating solution. The solvents for the coating solution include water and organic solvents such as alcohols, chlorinated hydrocarbons, ketones, esters and ether aromatic compounds and mixtures thereof. To the coating solution, agents for stabilizing the dispersion of fluorescent particles such as phthalic acid, stearic acid, caproic acid and surfactants may be added as well as plasticizers such as phosphoric acid esters, phthalic acid esters, glycolic acid esters, polyesters and polyethylene glycol.

In the screen used in the practice of the invention, a protective layer may be provided on the fluorescent layer. The protective layer is generally formed by coating a suitable coating solution on the fluorescent layer or by separately forming a protective film and laminating it to the fluorescent layer. When the coating method is used, the protective layer coating solution may be coated concurrently with the fluorescent layer or after the fluorescent layer is coated and dried. The material of which the protective layer is formed may be identical with or different from the binder of the fluorescent layer. The materials of which the protective layer is formed include those materials mentioned as the binder of the fluorescent layer, cellulose derivatives, polyvinyl chloride, melamine resins, phenol resins, and epoxy resins. Preferred are gelatin, corn starch, acrylic polymers, fluorinated olefin polymers, copolymers containing a fluorinated olefin, and styrene/acrylonitrile copolymers. The protective layer usually has a thickness of 1 to 20 82 m, preferably 2 to 10 μm, more preferably 2 to 6 μm. It is preferred to emboss the surface of the protective layer. A matte agent may be contained in the protective layer. Depending on the desired image quality, an agent capable of scattering light emission from the fluorescent substance such as titanium oxide may be added to the protective layer.

Surface lubricity may be imparted to the protective layer of the screen used in the practice of the invention. Preferred lubricants include polysiloxane skeleton-bearing oligomers and perfluoroalkyl group-bearing oligomers. Conductivity may also be imparted to the protective layer. The conductivity-imparting agents include white and transparent inorganic conductive substances and organic antistatic agents. Preferred inorganic conductive substances are ZnO powder and whiskers, $SnO_2$, and ITO.

EXAMPLE

Examples of the invention are given below by way of illustration and not by way of limitation.

Example 1

Double-sided three emulsion superposed photosensitive material for direct radiography Preparation of emulsion A for high-sensitivitv layer A reactor was charged with 1,582 ml of an aqueous gelatin solution (containing 19.5 g of gelatin-1 (deionized, alkali-treated bone gelatin having a methionine content of about 40 μmol/g) and 7.8 ml of a 1N $HNO_3$ solution, pH 4.3) and 13 ml of a NaCl-1 solution (containing 10 g/100 ml of NaCl). With the temperature kept at 400° C., 15.6 ml of an Ag-1 solution (containing 20 g/100 ml of $AgNO_3$) and 15.6 ml of a X-1 solution (containing 7.05 g/100 ml of NaCl) were concurrently added to the reactor at a rate of 62.4 ml/min. and mixed therein. After 3 minutes of agitation, 28.2 ml of an Ag-2 solution (containing 2 g/100 ml of $AgNO_3$) and 28.2 ml of a X-2 solution (containing 1.4 g/100 ml of KBr) were concurrently added to the reactor at a rate of 80.6 ml/min. and mixed therein. After 3 minutes of agitation, 46.8 ml of the Ag-l solution and 46.8 ml of the X-1 solution were concurrently added to the reactor at a rate of 62.4 ml/min. and mixed therein. After 2 minutes of agitation, 203 ml of an aqueous gelatin solution (containing 13 g of gelatin-1, 1.3 g of NaCl, and an amount of 1N NaOH solution to adjust to pH 6.5) was added to the solution to give pCl 1.75. Thereafter, the temperature was raised to 63° C., a hydrogen peroxide solution was added in an amount of $6\times10^{-4}$ mol/g of the gelatin to adjust to pCl 1.70, and the solution was ripened for 3 minutes. Thereafter, a AgCl fine grain emulsion (E-1) (mean particle diameter 0.1 μm) was added over 20 minutes at a rate of $2.68\times10^{-2}$ mol/min. of AgCl. At the end of addition, the solution was ripened for 40 minutes. A precipitant was added to the solution, which was cooled to a temperature of 350° C. to cause grains to sediment. After water washing, an aqueous gelatin solution was added to the grains and the emulsion was adjusted to pH 6.0 at 60° C. A TEM image of a replica of the grains was observed. The resultant emulsion was found to be an emulsion of silver chlorobromide {100} tabular grains containing 0.44 mol % based on silver of AgBr. The configurational characteristics of the grains were:

(the total projected area of {100} tabular grains having an aspect ratio between 2 and 25)/(the sum of projected areas of entire AgX grains)×100=al=91, an average aspect ratio (average diameter/average thickness) of {100} tabular grains having an aspect ratio between 2 and 25=a2=10.8, an average diameter of {100} tabular grains having an aspect ratio between 2 and 25=a3=1.40 μm, a side length ratio on the major plain of {100} tabular grains having an aspect ratio between 2 and 25=a4=1.40, an average thickness of {100} tabular grains having an aspect ratio between 2 and 25=a5=0.13 μm, a coefficient of variation of thickness distribution (standard deviation of thickness/average thickness) of {100} tabular grains having an aspect ratio between 2 and 25=a6 32 0.13, (projected area of {100} tabular grains having an aspect ratio between 2 and 25 wherein two transition lines are observable/projected area of {100} tabular grains having an aspect ratio between 2 and 25)×100=a7=87, an average of angles between two transition lines=a8=56°.

An observation by a direct TEM image of the tabular grains showed that even in the emulsion after coating, transition lines were observed for those grains accounting for 57% of the projected area.

Preparation of emulsion for high-sensitivity layer: chemical sensitization

While keeping at 56° C. with stirring, the emulsion was subject to chemical sensitization. First, thiosulfonic acid compound-I (shown below) was added in an amount of $3.1\times10^{-5}$ mol/mol of Ag. Then AgI fine grains having a diameter of 0.03 μm were added in an amount of 0.11 mol % based on the entire silver and 0.043 mg of thiourea dioxide was further added to the emulsion, which was kept at the temperature for 22 minutes for reduction sensitization. Then, 20 mg of 4-hydroxy-6-methyl-1,3,3a,7-tetraazaindene, a dispersion of sensitizing dye-I (shown below) in an amount corresponding to 565 mg of sensitizing dye-I, and 2.2 mg of sensitizing dye-II (shown below) were added. Further, 0.76 g of calcium chloride was added. In succession, 0.29 mg of sodium thiosulfate, 0.76 mg of selenium compound-I (shown below), 1.8 mg of chloroauric acid, and 85 mg of potassium thiocyanate were added to the emulsion, which was ripened for 58 minutes. Thereafter, 25 mg of sodium sulfite was added for further ripening. After 105 minutes from the addition of chloroauric acid, 39.9 mg of compound-I (shown below) was added to the emulsion, which was cooled to 35° C. after 4 minutes. In this way, preparation or chemical ripening of the high-sensitivity layer emulsion was completed.

thiosulfonic acid compound-I $C_2H_5SO_2SNa$ sensitizing dye-I

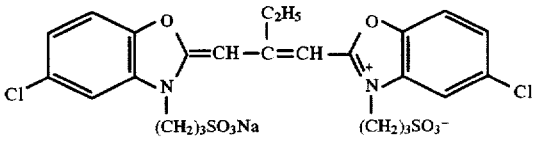

-continued sensitizing dye-II

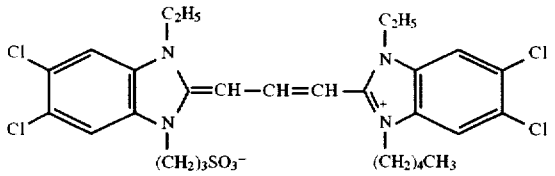

selenium compound-I

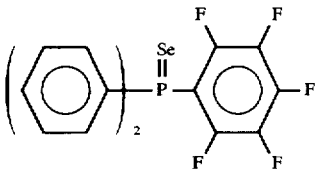

compound-I

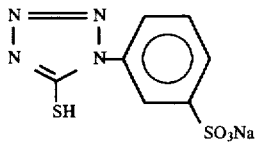

It is noted that the dispersion of sensitizing dye-I used above was prepared by mechanically agitating 1 g of sensitizing dye-I in 50 ml of water at pH 7.0±0.5 and 50° to 650° C. at 2,000 to 2,500 rpm by means of a dissolver so as to disperse solid fine particles of less than 1 μm in size, adding 50 g of 10% gelatin, mixing and cooling.

Preparation of medium-sensitivity emulsion B for low-sensitivity layer

A reactor was charged with 1,582 ml of an aqueous gelatin solution (containing 19.5 g of gelatin-1 (deionized, alkali-treated bone gelatin having a methionine content of about 40 μmol/g) and 7.8 ml of a 1N $HNO_3$ solution, pH 4.3) and 13 ml of a NaCl-1 solution (containing 10 g/100 ml of NaCl). With the temperature kept at 40° C., 15.6 ml of an Ag-1 solution (containing 20 g/100 ml of $AgNO_3$) and 15.6 ml of a X-1 solution (containing 7.05 g/100 ml of NaCl) were concurrently added to the reactor at a rate of 62.4 ml/min. and mixed therein. After 3 minutes of agitation, 28.2 ml of a X-2 solution (containing 1.1 g/100 ml of KBr) was added to the reactor at a rate of 80.6 ml/min. and mixed therein. After 3 minutes of agitation, 46.8 ml of the Ag-1 solution and 46.8 ml of the X-1 solution were concurrently added to the reactor at a rate of 62.4 ml/min. and mixed therein. After 2 minutes of agitation, 203 ml of an aqueous gelatin solution (containing 13 g of gelatin-1, 1.3 g of NaCl, and an amount of 1N NaOH solution to adjust to pH 6.5) was added to the solution to give pCl 1.75. Thereafter, the temperature was raised to 63° C., a hydrogen peroxide solution was added in an amount of $6\times10^{-4}$ mol/g of the gelatin to adjust to pCl 1.95, and the solution was ripened for 3 minutes. Thereafter, a Ag-2 solution (containing 500 g/100 ml of $AgNO_3$) and a X-3 solution (containing 16.9 g/100 ml of NaCl and 1.4 g/100 ml of KBr) were added for 20 minutes at a constant flow rate by the controlled double jet method until the amount of Ag-3 solution added reached 182 ml. A precipitant was added to the solution, which was cooled to a temperature of 35° C. to cause grains to sediment. After water washing, an aqueous gelatin solution was added to the grains and the emulsion was adjusted to pH 6.0 at 60° C. A TEM image of a replica of the grains was observed. The resultant emulsion was found to be an emulsion of silver chlorobromide {100} tabular grains containing 3.94 mol % based on silver of AgBr. The configurational characteristics of the grains which grew so that their projected area reached 75% of the projected area of completed grains were: a1=91, a2=13.7, a3=1.51 μm, a4 =1.21, a5=0.11 μm, a6=0.13, a7=85, a8=57°.

An observation by a direct TEM image of the tabular grains showed that even in the emulsion after coating, transition lines were observed for those grains accounting for 75% of the projected area.

Preparation of medium-sensitivity emulsion for low-sensitivity layer: chemical ripening While keeping at 560° C. with stirring, the emulsion was subject to chemical sensitization. First, the thiosulfonic acid compound-1 identified above was added in an amount of $3.5\times10^{-5}$ mol/mol of Ag. Then AgI fine grains having a diameter of 0.03 μm were added in an amount of 0.26 mol % based on the entire silver and 0.043 mg of thiourea dioxide was further added to the emulsion, which was kept at the temperature for 22 minutes for reduction sensitization. Then, 20 mg of 4-hydroxy-6-methyl-1,3,3a,7-tetraazaindene, a dispersion of sensitizing dye-I identified above in an amount corresponding to 525 mg of sensitizing dye-I, and 2.2 mg of sensitizing dye-II identified above were added. Further, 1 g of calcium chloride was added. In succession, 0.95 mg of sodium thiosulfate, 2.3 mg of selenium compound-I identified above, 2.6 mg of chloroauric acid, and 60 mg of potassium thiocyanate were added to the emulsion, which was ripened for 60 minutes. Thereafter, 15 mg of sodium sulfite was added for further ripening. After 105 minutes from the addition of chloroauric acid, 73.5 mg of compound-1 identified above was added to the emulsion, which was cooled to 35° C. after 4 minutes. In this way, preparation or chemical ripening of the medium-sensitivity layer emulsion for the low-sensitivity layer was completed.

Preparation of low-sensitivity emulsion for low-sensitivity layer

A reactor was charged with 1,582 ml of an aqueous gelatin solution (containing 19.5 g of gelatin-1 (deionized, alkali-treated bone gelatin having a methionine content of about 40 μmol/g) and 7.8 ml of a 1N $HNO_3$ solution, pH 4.3) and 13 ml of a NaCl-1 solution (containing 10 g/100 ml of NaCl). With the temperature kept at 40° C., 15.6 ml of an Ag-1 solution (containing 20 g/100 ml of $AgNO_3$) and 15.6 ml of a X-1 solution (containing 7.05 g/100 ml of NaCl) were concurrently added to the reactor at a rate of 62.4 ml/min. and mixed therein. After 3 minutes of agitation, 28.2 ml of an Ag-2 solution (containing 2 g/100 ml of $AgNO_3$) and 28.2 ml of a X-2 solution (containing 1.4 g/100 ml of KBr) were concurrently added to the reactor at a rate of 80.6 ml/min. and mixed therein. After 3 minutes of agitation, 46.8 ml of the Ag-1 solution and 46.8 ml of the X-1 solution were concurrently added to the reactor at a rate of 62.4 ml/min. and mixed therein. After 2 minutes of agitation, 203 ml of an aqueous gelatin solution (containing 13 g of gelatin-1, 1.3 g of NaCl, and an amount of 1N NaOH solution to adjust to pH 5.5) was added to the solution to give pCl 1.8. Thereafter, the temperature was raised to 75° C., and the solution was adjusted to pCl 1.8 and ripened for 42 minutes. Thereafter, a AgCl fine grain emulsion (mean particle diameter 0.1 μm) was added over 20 minutes at a rate of $2.68\times10^{-2}$ mol/min. of AgCl. At the end of addition, the solution was ripened for 10 minutes. A precipitant was added to the solution, which was cooled to a temperature of 35° C. to cause grains to sediment. After water washing, an aqueous gelatin solution was added to the grains and the emulsion was adjusted to pH 6.0 at 60° C. A TEM image of a replica of the grains was observed. The resultant emulsion was found to be an emulsion of silver chlorobromide {100} tabular grains containing 0.44 mol % based on silver of AgBr. The configurational characteristics of the grains were:

(the total projected area of tabular grains having an aspect ratio of more than 2)/(the sum of projected areas of entire AgX grains)×100=a1=90%, an average aspect ratio (average diameter/average thickness) of tabular grains=a2=9.3, an average diameter of tabular grains=a3=1.67 μm, and an average thickness=a4=0.18 μm.

Preparation of low-sensitivity emulsion for low-sensitivity layer: chemical ripening While keeping at 54° C. with stirring, the emulsion was subject to chemical sensitization. First, the thiosulfonic acid compound-1 identified above was added in an amount of $3.4\times10^{-5}$ mol/mol of Ag. Then AgI fine grains having a diameter of 0.03 μm were added in an amount of 0.19 mol % based on the entire silver and 0.043 mg of thiourea dioxide was further added to the emulsion, which was kept at the temperature for 22 minutes for reduction sensitization. Then, 114 mg of 4-hydroxy-6-methyl-1,3,3a,7-tetraazaindene, a dispersion of sensitizing dye-I identified above in an amount corresponding to 654 mg of sensitizing dye-I, and 2.2 mg of sensitizing dye-II identified above were added. Further, 0.83 g of calcium chloride was added. In succession, 4 mg of sodium thiosulfate, 0.88 mg of selenium compound-I identified above, 1.9 mg of chloroauric acid, and 25 mg of potassium thiocyanate were added to the emulsion, which was ripened for 60 minutes. Thereafter, 20 mg of sodium sulfite was added for further ripening. After 105 minutes from the addition of chloroauric acid, 30.1 mg of compound-1 identified above and 188 mg of a sensitizing dye-III (shown below) were added to the emulsion, which was cooled to 35° C. after 4 minutes. In this way, preparation or chemical ripening of the low-sensitivity layer emulsion for the low-sensitivity layer was completed.

sensitizing dye-III

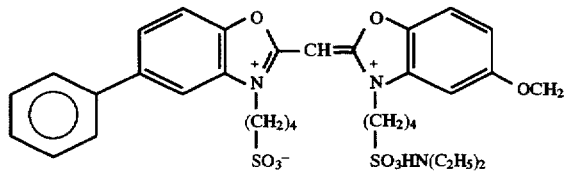

Preparation of high-sensitivity layer emulsion coating solution

An emulsion coating solution was obtained by adding the following chemicals to the chemically sensitized high-sensitivity emulsion. The amounts of the chemicals are per mol of the silver halide. Mw is an average molecular weight.

| | |
|---|---|
| Gelatin (including gelatin in emulsion) | 167 g |
| Dextran (Mw 39,000) | 54.7 g |
| Trimethylolpropane | 9.0 g |
| Sodium polyacrylate (Mw 400,000) | 5.1 g |
| Ethyl acrylate/acrylic acid (96.4/3.6) copolymer | 26.5 g |
| Sodium polystyrenesulfonate (Mw 600,000) | 3.7 g |
| Potassium iodide | 118 mg |
| Hardener 1,2-bis(vinylsulfonylacetamide)ethane | 9.9 g |
| Compound-I | 35.6 mg |
| Compound-II | 26.1 mg |
| Compound-III | 0.28 g |

-continued

| | |
|---|---|
| Compound-IV | 8.5 mg |
| Compound-V | 0.47 g |
| Compound-VI | 4 mg |
| Compound-VII | 47.3 mg |
| Compound-VIII | 0.1 g |
| Compound-IX | 0.1 g |
| (adjusted to pH 6.2 with NaOH) | |

Note that Compound-I is as defined above and Compound-II to Compound-IX are shown below.

Note that compound-I is as defined above and compound-II to compound-IX are shown below.

compound-II

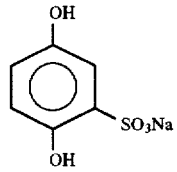

compound-III

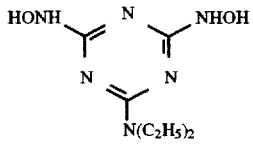

compound-IV

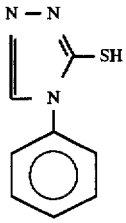

compound-V

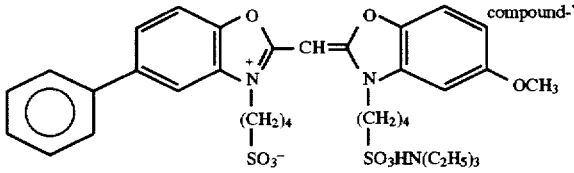

compound-VI

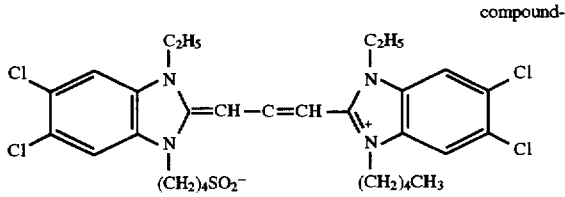

compound-VII

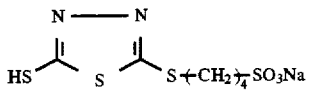

compound-VIII

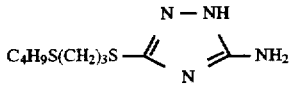

compound-IX

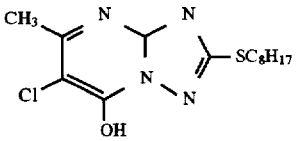

Preparation of low-sensitivity layer emulsion coating solution

An emulsion coating solution was obtained by adding the following chemicals to a 2/1 mixture of the chemically sensitized medium-sensitivity emulsion and the chemically sensitized low-sensitivity emulsion for the low-sensitivity layer. The amounts of the chemicals are per mol of the silver halide. Mw is an average molecular weight.

| | |
|---|---|
| Gelatin (including gelatin in emulsion) | 80 g |
| Dextran (Mw 39,000) | 11.6 g |
| Trimethylolpropane | 9.0 g |
| Sodium polyacrylate (Mw 400,000) | 5.1 g |
| Sodium polystyrenesulfonate (Mw 600,000) | 1.3 g |
| Hardener 1,2-bis(vinylsulfonylacetamide)ethane | 2.0 g |
| Compound-I | 72.6 mg |
| Compound-II | 5.3 g |
| Compound-III | 0.58 g |
| Compound-IV | 27.4 mg |
| Compound-V | 0.14 g |
| Compound-VI | 4 mg |
| Compound-VII | 57.4 mg |
| Compound-VIII | 0.1 g |
| Compound-IX | 0.1 g |
| (adjusted to pH 6.1 with NaOH) | |

A dye emulsion A was added to the coating solution so as to give 10 mg/m$^2$ of dye-I (shown below) on one surface.

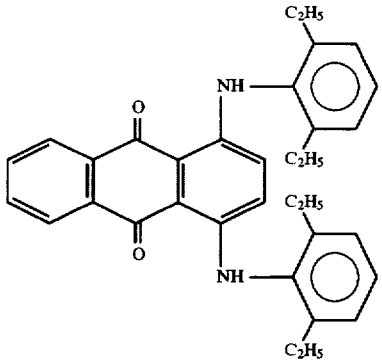

dye-I

Preparation of dye emulsion A

Dye-I, 60 g, was dissolved in 62.8 g of high-boiling organic solvent-I, 62.8 g of high-boiling organic solvent-II, and 333 g of ethyl acetate at 60° C. To the solution were added 65 ml of a 5% aqueous solution of sodium dodecylbenzenesulfonate, 94 g of gelatin, and 581 ml of water. The mixture was emulsified and dispersed for 30 minutes at 60° C. by means of a dissolver. Then 2 g of methyl p-hydroxybenzoate and 6 liters of water were added to the dispersion, which was cooled to 40° C. Using a ultrafiltration Labomodule ACP1050 by Asahi Chemicals K.K., the dispersion was concentrated to a total amount of 2 kg. Addition of 1 g of methyl p-hydroxybenzoate to the dispersion yielded a dye emulsion A.

high-boiling organic solvent-I

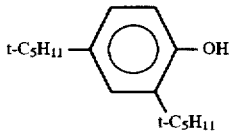

-continued high-boiling organic solvent-II

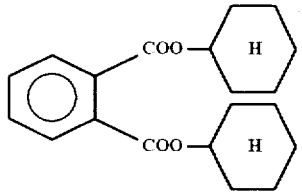

Preparation of surface protective layer coating solution A surface protective layer coating solution was prepared by mixing the following components so that the respective components gave the following coverage (g/m$^2$).

| Component | g/m$^2$ |
|---|---|
| Gelatin | 0.600 |
| Sodium polyacrylate (Mw 400,000) | 0.025 |
| Sodium polystyrenesulfonate (Mw 600,000) | 0.0012 |
| Methacrylic acid/methyl methacrylate/ styrene (7/76/17) copolymer (mean particle size 4.0 μm) | 0.074 |
| Coating aid-I | 0.014 |
| Coating aid-II | 0.036 |
| Coating aid-III | 0.0069 |
| Coating aid-IV | 0.0032 |
| Coating aid-V | 0.0012 |
| Compound-X | 0.0008 |
| 4-hydroxy-6-methyl-1,3,3a,7-tetraazaindene | 0.0057 |
| Compound-XI | 0.0007 |
| Proxisel | 0.0010 |
| (adjusted to pH 6.8 with NaOH) | |

Note that coating aid-I to coating aid-V, compound-X and compound-XI are shown below.

coating aid-I

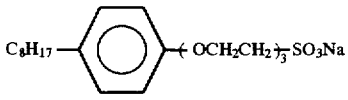

coating aid-II $C_{15}H_{33}O(CH_2CH_2O)_{10}H$ coating aid-III $C_8H_{17}CH{=}CHC_7H_{14}CON(CH_3)CH_2CH_2SO_3Na$ coating aid-IV $C_8F_{17}SO_2N(C_3H_7)(CH_2CH_2O)_{15}H$ coating aid-V $C_8F_{17}SO_2N(C_3H_7)(CH_2CH_2O)_4(CH_2)_4SO_2Na$ compound-X

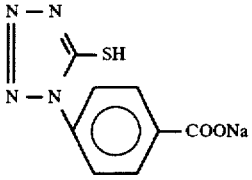

compound-XI

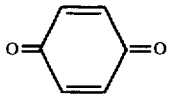

Preparation of support (1) Preparation of undercoat layer dye dispersion B Dye-II (shown below) was ball milled by the method of JP-A 197943/1988.

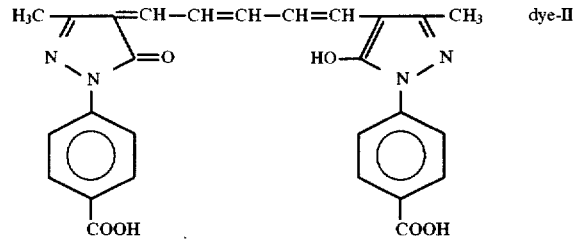

A 2-liter ball mill was charged with 434 ml of water and 791 cc of a 6.7% aqueous solution of Triton® X200 surfactant. To the solution was added 20 g of dye-II. With 400 ml of zirconia ($Zro_2$) beads having a diameter of 2 mm added, the contents were milled for 4 days. Thereafter, 160 g of a 12.5% gelatin solution was added. After deaeration, the zirconia beads were removed by filtration. The resulting dye dispersion was examined to find that the milled dye had a broad particle size distribution from 0.05 μm to 1.15 μm and a mean particle size of 0.37 μm. Coarse dye particles having a diameter of more than 0.9 μm were removed by centrifugation. A dye dispersion B was obtained in this way.

(2) Preparation of support

A biaxially oriented, blue colored polyethylene terephthalate film of 175 μm thick was subject to a corona discharge. The PET used herein contained 0.04% by weight of dye-I. A first undercoat solution of the composition shown below was coated on one surface of the PET film to a coverage of 4.9 ml/m$^2$ by a wire bar coater and dried at 185° C. for one minute to form a first undercoat layer. Another first undercoat layer was similarly formed on the opposite surface.

First undercoat solution

| | |
|---|---|
| Butadiene-styrene copolymer latex (solids 40%, butadiene/styrene weight ratio = 31/69) | 158 ml |
| 4% solution of sodium 2,4-dichloro-6-hydroxy-s-triazine | 41 ml |
| Distilled water | 300 ml |

On each of the first undercoat layers, a second undercoat solution of the composition shown below was coated to a coverage (mg/m$^2$) as shown below by a wire bar coater and dried at 155° C. to form a second undercoat layer.

Second undercoat solution

| | |
|---|---|
| Gelatin-styrene copolymer latex | 160 mg/m$^2$ |
| Dye dispersion B (as dye solids) | 25 mg/m$^2$ |
| Coating aid-VI | 1.8 mg/m$^2$ |
| Proxisel | 0.27 mg/m$^2$ |
| Matte agent polymethyl methacrylate (mean particle size 2.5 μm) | 2.5 g/m$^2$ |

Note that Coating aid-VI is $C_{12}H_{25}O(CH_2CH_2O)_{10}H$.

Preparation of photosensitive material

On the support prepared as above, the low-sensitivity layer emulsion coating solution, the high-sensitivity layer emulsion coating solution and the surface protective layer coating solution (in the order from a layer nearer to the support) were coated by a co-extrusion method, forming three layers on each surface. The silver coverage on one surface is 0.3 g/m$^2$ for the high-sensitivity layer and 1.1 g/m$^2$ for the low-sensitivity layer.

In this way, there was obtained a silver halide photographic photosensitive material according to the invention, designated photosensitive material No. 1.

In a comparative example, emulsions were prepared as follows. Using these emulsions, a photosensitive material No. 2 for comparison purposes was prepared as was photosensitive material No. 1.

Preparation of silver bromide tabular grain emulsion for comparison purposes

Preparation of sure silver bromide tabular grains for high-sensitivity layer

A reactor kept at 74° C. was charged with 1.11 liters of water, 6.52 g of potassium bromide, and 11.6 g of a low molecular weight gelatin having an average molecular weight of 15,000. With stirring, 21.6 ml of a silver nitrate aqueous solution (2.40 g of silver nitrate) and 38.5 ml of an aqueous solution containing 5.9 g of potassium bromide were added to the reactor over 37 seconds by the double jet method. After an aqueous solution containing 26 g of gelatin was added, 104.1 ml of a silver nitrate aqueous solution (11.5 g of silver nitrate) was added over 11.5 minutes. At this point, 18 ml of a 25% aqueous ammonia was added to the solution, which was physically ripened at the temperature for 10 minutes. Then 15.7 ml of a 100% acetic acid aqueous solution was added. Subsequently, an aqueous solution containing 187.7 g of silver nitrate and an aqueous solution of potassium bromide were added to the solution over 75 minutes by the double jet method while maintaining pAg 8.5. The flow rate was controlled such that the flow rate at the end of addition was 3.2 times the flow rate at the start of addition. At the end of addition, 44 ml of a 2N potassium thiocyanate solution was added to the solution, which was physically ripened at the temperature for 5 minutes. The temperature was then lowered to 35° C. There were obtained monodisperse pure silver bromide tabular grains having a mean projected area equivalent diameter of 1.80 μm, a thickness of 0.316 μm, and a coefficient of variation of diameter of 19.5%.

Thereafter, the soluble salts were removed by flocculation. The emulsion was heated again to 40° C. Then 63.3 g of gelatin, 2.9 g of phenoxyethanol, and 1.4 g of sodium polystyrenesulfonate as a thickener were added to the emulsion, which was adjusted to pH 6.05 and pAg 8.70 with sodium hydroxide, potassium bromide and silver nitrate aqueous solutions.

Preparation of emulsion for high-sensitivity layer: chemical sensitization

While keeping at 56° C. with stirring, the emulsion was subject to chemical sensitization. First, thiosulfonic acid compound-I (shown below) was added in an amount of $3.1\times10^{-5}$ mol/mol of Ag. Then AgI fine grains having a diameter of 0.03 μm were added in an amount of 0.11 mol % based on the entire silver and 0.043 mg of thiourea dioxide was further added to the emulsion, which was kept at the temperature for 22 minutes for reduction sensitization. Then, 20 mg of 4-hydroxy-6-methyl-1,3,3a,7-tetraazaindene, a dispersion of sensitizing dye-I (shown below) in an amount corresponding to 565 mg of sensitizing dye-I, and 2.2 mg of sensitizing dye-II (shown below) were added. Further, 0.76 g of calcium chloride was added. In succession, 0.29 mg of sodium thiosulfate, 0.76 mg of selenium compound-I (shown below), 1.8 mg of chloroauric acid, and 85 mg of potassium thiocyanate were added to the emulsion, which was ripened for 58 minutes. Thereafter, 25 mg of sodium sulfite was added for further ripening. After 105 minutes from the addition of chloroauric acid, 39.9 mg of compound-I (shown below) was added to the emulsion, which was cooled to 35° C. after 4 minutes. In this way, preparation or chemical ripening of the high-sensitivity layer emulsion was completed.

thiosulfonic acid compound-I $C_2H_5SO_2SNa$ sensitizing dye-I

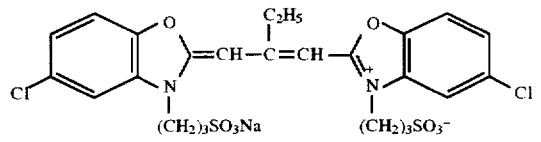

sensitizing dye-II

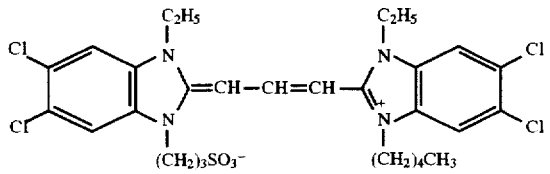

selenium compound-I

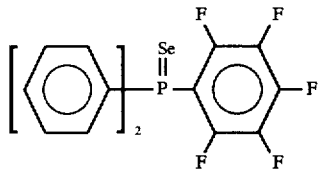

compound-I

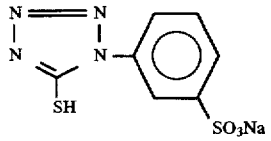

It is noted that the dispersion of sensitizing dye-I used above was prepared by mechanically agitating 1 g of sensitizing dye-I in 50 ml of water at pH 7.0±0.5 and 50 to 65° C. at 2,000 to 2,500 rpm by means of a dissolver so as to disperse solid fine particles of less than 1 μm in size, adding 50 g of 10% gelatin, mixing and cooling.

Preparation of medium-sensitivity pure silver bromide tabular grains for low-sensitivity layer A reactor kept at 55° C. was charged with 1 liter of water, 6.9 g of potassium bromide, and 7.6 g of a low molecular weight gelatin having an average molecular weight of 15,000. With stirring, 36 ml of a silver nitrate aqueous solution (3.96 g of silver nitrate) and 38 ml of an aqueous solution containing 5.9 g of potassium bromide were added to the reactor over 37 seconds by the double jet method. After an aqueous solution containing 18.4 g of gelatin was added, 91 ml of a silver nitrate aqueous solution (10.0 g of silver nitrate) was added over 21.5 minutes while heating at 70° C. At this point, 7.7 ml of a 25% aqueous ammonia was added to the solution, which was physically ripened at the temperature for 10 minutes. Then 7.2 ml of a 100% acetic acid aqueous solution was added. Subsequently, an aqueous solution containing 151.5 g of silver nitrate and an aqueous solution of potassium bromide were added to the solution over 35 minutes by the controlled double jet method while maintaining pAg 8.5. The flow rate was controlled such that the flow rate at the end of addition was 5.5 times the flow rate at the start of addition. At the end of addition, 35 ml of a 2N potassium thiocyanate solution was added to the solution, which was physically ripened at the temperature for 5 minutes. The temperature was then lowered to 35° C. There were obtained monodisperse pure silver bromide tabular grains having a mean projected area equivalent diameter of 1.04 μm, a thickness of 0.170 μm, and a coefficient of variation of diameter of 18.5%.

Thereafter, the soluble salts were removed by flocculation. The emulsion was heated again to 40° C. Then 35 g of gelatin, 1.65 g of phenoxyethanol, and 0.8 g of sodium polystyrenesulfonate as a thickener were added to the emulsion, which was adjusted to pH 5.90 and pAg 8.00 with sodium hydroxide, potassium bromide and silver nitrate aqueous solutions.

Preparation of medium-sensitivity emulsion for low-sensitivity layer: chemical ripening While keeping at 56° C. with stirring, the emulsion was subject to chemical sensitization. First, the thiosulfonic acid compound-1 identified above was added in an amount of $3.5\times10^{-5}$ mol/mol of Ag. Then AgI fine grains having a diameter of 0.03 μm were added in an amount of 0.26 mol % based on the entire silver and 0.043 mg of thiourea dioxide was further added to the emulsion, which was kept at the temperature for 22 minutes for reduction sensitization. Then, 20 mg of 4-hydroxy-6-methyl-1,3,3a,7-tetraazaindene, a dispersion of sensitizing dye-I identified above in an amount corresponding to 525 mg of sensitizing dye-I, and 2.2 mg of sensitizing dye-II identified above were added. Further, 1 g of calcium chloride was added. In succession, 0.95 mg of sodium thiosulfate, 2.3 mg of selenium compound-I identified above, 2.6 mg of chloroauric acid, and 60 mg of potassium thiocyanate were added to the emulsion, which was ripened for 60 minutes. Thereafter, 15 mg of sodium sulfite was added for further ripening. After 105 minutes from the addition of chloroauric acid, 73.5 mg of compound-1 identified above was added to the emulsion, which was cooled to 35° C. after 4 minutes. In this way, preparation or chemical ripening of the medium-sensitivity layer emulsion for the low-sensitivity layer was completed.

Preparation of low-sensitivity sure silver bromide tabular grains for low-sensitivity layer A reactor kept at 400° C. was charged with 1 liter of water, 6.9 g of potassium bromide, and 6.3 g of a low molecular weight gelatin having an average molecular weight of 15,000. With stirring, 36 ml of a silver nitrate aqueous solution (3.97 g of silver nitrate) and 38 ml of an aqueous solution containing 5.9 g of potassium bromide were added to the reactor over 37 seconds by the double jet method. After an aqueous solution containing 18.4 g of gelatin was added, 89 ml of a silver nitrate aqueous solution (9.7 g of silver nitrate) was added over 21.5 minutes while heating at 60° C. At this point, 5.1 ml of a 25% aqueous ammonia was added to the solution, which was physically ripened at the temperature for 10 minutes. Then 4.7 ml of a 100% acetic acid aqueous solution was added. Subsequently, an aqueous solution containing 151.5 g of silver nitrate and an aqueous solution of potassium bromide were added to the solution over 35 minutes by the controlled double jet method while maintaining pAg 8.5. The flow rate was accelerated such that the flow rate at the end of addition was 5.7 times the flow rate at the start of addition. At the end of addition, 35 ml of a 2N potassium thiocyanate solution was added to the solution, which was physically ripened at the temperature for 5 minutes. The temperature was then lowered to 35° C. There were obtained monodisperse pure silver bromide tabular grains having a mean projected area equivalent diameter of 0.73 μm, a thickness of 0.145 μm, and a coefficient of variation of diameter of 18%.

Thereafter, the soluble salts were removed by flocculation. The emulsion was heated again to 40° C. Then 35 g of gelatin, 85 mg of proxisel, and 0.4 g of sodium polystyrenesulfonate as a thickener were added to the emulsion, which was adjusted to pH 6.40 and pAg 8.00 with sodium hydroxide, potassium bromide and silver nitrate aqueous solutions.

Preparation of low-sensitivity emulsion for low-sensitivity layer: chemical ripening While keeping at 54° C. with stirring, the emulsion was subject to chemical sensitization. First, the thiosulfonic acid compound-1 identified above was added in an amount of $3.4\times10^{-5}$ mol/mol of Ag. Then AgI fine grains having a diameter of 0.03 μm were added in an amount of 0.19 mol % based on the entire silver and 0.043 mg of thiourea dioxide was further added to the emulsion, which was kept at the temperature for 22 minutes for reduction sensitization. Then, 114 mg of 4-hydroxy-6-methyl-1,3,3a,7-tetraazaindene, a dispersion of sensitizing dye-I identified above in an amount corresponding to 654 mg of sensitizing dye-I, and 2.2 mg of sensitizing dye-II identified above were added. Further, 0.83 g of calcium chloride was added. In succession, 4 mg of sodium thiosulfate, 0.88 mg of selenium compound-1 identified above, 1.9 mg of chloroauric acid, and 25 mg of potassium thiocyanate were added to the emulsion, which was ripened for 60 minutes. Thereafter, 20 mg of sodium sulfite was added for further ripening. After 105 minutes from the addition of chloroauric acid, 30.1 mg of compound-1 identified above and 188 mg of a sensitizing dye-III (shown below) were added to the emulsion, which was cooled to 35° C. after 4 minutes. In this way, preparation or chemical ripening of the low-sensitivity layer emulsion for the low-sensitivity layer was completed.

sensitizing dye-III

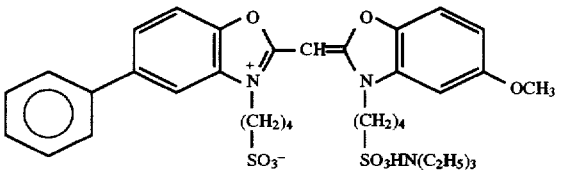

In this way, photosensitive material No. 2 was prepared.

Additional photosensitive materials Nos. 3 to 9 were prepared as were Nos. 1 and 2 while changing some parameters as shown in Table 1.

TABLE 1

| Photosensitive material No. | Main silver halide composition | Silver coverage per surface (g/m²) | Swelling factor (%) | Gelatin coverage per surface (g/m²) | Crossover (%) |
|---|---|---|---|---|---|
| No. 1* | silver chloride | 1.4 | 170 | 1.88 | 8 |
| No. 2 | silver bromide | 1.4 | 170 | 1.88 | 8 |
| No. 3 | silver chloride | 1.6 | 170 | 1.88 | 7 |
| No. 4 | silver chloride | 1.9 | 170 | 1.88 | 6 |
| No. 5 | silver chloride | 1.3 | 190 | 1.88 | 9 |
| No. 6 | silver chloride | 1.3 | 210 | 1.88 | 9 |
| No. 7 | silver chloride | 1.3 | 170 | 2.3 | 9 |
| No. 8 | silver chloride | 1.3 | 170 | 2.5 | 9 |
| No. 9* | silver chloride | 1.3 | 170 | 1.9 | 9 |

*within the scope of the invention

Preparation of developer concentrate

A developer concentrate A of the following formulation containing sodium erythorbate as a developing agent was prepared.

| | |
|---|---|
| Diethylenetriaminepentaacetic acid | 8.0 g |
| Sodium sulfite | 20.0 g |
| Sodium carbonate monohydrate | 52.0 g |
| Potassium carbonate | 55.0 g |
| Sodium erythorbate | 60.0 g |
| 4-hydroxymethyl-4-methyl-1-phenyl-3-pyrazolidone | 13.2 g |
| 3,3'-diphenyl-3,3'-dithiopropionic acid | 1.44 g |
| Diethylene glycol | 50.0 g |
| Water | totaling to 1 liter |

(adjusted to pH 10.4 with sodium hydroxide)

Preparation of developer replenisher

A developer replenisher was obtained by diluting the developer concentrate with water by a factor of 2 by volume.

Preparation of developing tank solution

A developing tank solution at pH 9.5 was prepared by diluting 2 liters of the developer concentrate with water to a total volume of 4 liters, and adding 60 ml per liter of the diluted developer of a starter of the following composition.

| | |
|---|---|
| Potassium bromide | 11.7 g |
| Acetic acid (90%) | 12.0 g |
| Water | totaling to 60 ml |

Preparation of fixer concentrate

A fixer concentrate of the following composition was prepared.

| | |
|---|---|
| Water | 0.5 liter |
| Ethylenediaminetetraacetic acid dihydrate | 0.05 g |
| Sodium thiosultate | 290.0 g |
| Sodium bisulfite | 98.0 g |
| Sodium hydroxide | 2.9 g |
| Water | totaling to 1 liter |

(adjusted to pH 5.2 with sodium hydroxide)

Preparation of fixer replenisher

A fixer replenisher was obtained by diluting the fixer concentrate with water by a factor of 4 by volume.

Preparation of fixing tank solution

A fixing tank solution at pH 5.4 was prepared by diluting 2 liters of the fixer concentrate with water to a total volume of 8 liters.

Exposure and processing of photosensitive material

The photosensitive material samples, Nos. 1 to 9, were exposed to X-ray through fluorescent screens, a HGM screen (maximum emission wavelength 546 nm) and a HGH screen (maximum emission wavelength 546 nm) both manufactured by Fuji Photo-Film Co., Ltd. There were furnished a number of samples which were exposed so as to give a blackening factor of 50% of the entire silver weight.

A continuous processing test was carried out by using the above-prepared developer and fixer, and modifying the drive system and tanks of an automatic processor Sepros S manufactured by Fuji Photo-Film Co., Ltd., and setting the following steps and replenishment amounts (to which the amounts of spent solutions were approximately equal, expressed by ml per square meter of photosensitive

| Step | Temp. | Time | Tank volume |
|---|---|---|---|
| Development | 35° C. | 13 sec. | 6 liters |
| Fixation | 32° C. | 10 sec. | 6 liters |
| 1st washing | 20° C | 6 sec. | 4 liters |

-continued

| Step | Temp. | Time | Tank volume |
|---|---|---|---|
| 2nd washing | 20° C. | 6 sec. | 4 liters |
| Drying | | 10 sec. | |
| Total | | 45 sec. | |
| Developer replenishment | | 100 ml/m$^2$ | |
| Fixer replenishment | | 100 ml/m$^2$ (excluding overflow from 1st washing bath) | |
| Water replenishment | | 100 ml/m$^2$ | |

It is noted that a two-stage water washing system was used and washing water was replenished to the second washing bath in a two-stage counterflow manner. The overflow from the first washing bath was 80 ml/m$^2$ of photosensitive material and used as a diluent for the fixer.

The processor was internally equipped with tanks with a volume of 10 liters for receiving spent solutions of the developer and the fixer. Heat rollers mounted in the drying section were the same as used in automatic processor Sepros M2 manufactured by Fuji Photo-Film Co., Ltd. The rollers were heated at 85° C. The vapor duct was removed.

With respect to the photosensitive material samples, Nos. 1–9, the crossover was evaluated as follows. The results are also shown in Table 1.

Evaluation of crossover

Using a cassette, a GRENEX ortho-screen HR-4 (maximum emission wavelength 546 nm) manufactured by Fuji Photo-Film Co., Ltd. was placed close to one surface of the sample, which was examined by X-ray sensitometry. After the same processing as done in the evaluation of photographic performance, the sensitivity of the surface in contact with the screen (front surface) and the sensitivity of the opposite surface (back surface) were determined. The sensitivity is logE wherein E is an exposure necessary to provide a density higher by 1.0 than the density of base+fog. Using the difference between these sensitivities, the percent crossover light was calculated according to the following equation.

$$\text{Crossover light (\%)}=1/\{\text{antilog}(\Delta \log E)+1\}\times 100$$

A change of development activity, fixation and drying were examined as follows. The results are shown in Table 2.

Change of development activity

Using control strips (films which were previously given sensitometric exposure using an optical wedge), a change of sensitivity (logE) before and after processing of 100 sheets of the quarter-size (10×12 inches) under the above-mentioned conditions was determined to examine a change of development activity. It is expressed by a sensitivity difference (ΔS) in Table 2.

Fixation

The processed photosensitive material sample was visually observed to inspect a degree of stain corresponding to the amount of residual silver halide (unexposed portion). The sample was rated "O" for good, "Δ" for somewhat poor, and "X" for poor.

Drying

Photosensitive material sheets of 35 cm×35 cm were processed through the processor on a time schedule of 45 seconds. The film exiting from the drying zone outlet was touched with fingers for examining a dry state. The sample was rated "O" for good, "Δ" for somewhat poor, and "X" for poor.

TABLE 2

| Photosensitive material | ΔS | Fixation | Drying |
|---|---|---|---|
| No. 1 | −0.01 logE | ○ | ○ |
| No. 2 | −0.31 logE | X | ○ |
| No. 3 | −0.24 logE | Δ | ○ |
| No. 4 | −0.22 logE | Δ | ○ |
| No. 5 | −0.23 logE | ○ | X |
| No. 6 | −0.20 logE | ○ | X |
| No. 7 | −0.18 logE | ○ | X |
| No. 8 | −0.16 logE | ○ | X |
| No. 9 | −0.01 logE | ○ | ○ |

It is evident that superior results are obtained with the present invention. The hourly throughput of the modified processor was 320 sheets of the quarter-size (10×12 inches). Image quality factors such as sharpness and silver sludging were found acceptable.

Example 2

Photosensitive material sample Nos. 10 and 11 were prepared by the same procedure as No. 1 in Example 1. No. 10 was obtained by removing the undercoat dye layer from No. 1. No. 11 was obtained by removing the undercoat dye layer from No. 1, and changing the silver coverage of the high-sensitivity layer to 0.3 g/m$^2$ and the silver coverage of the low-sensitivity layer to 2.0 g/m$^2$.

These samples were examined for crossover as in Example 1. Sample No. 10 showed a crossover of 23% and sample No. 11 showed a crossover of 8% which was identical with sample No. 1.

A running test as in Example 1 was performed on photosensitive material sample Nos. 1, 10 and 11. Sample No. 10 showed equal performance to No. 1, but was inferior in sharpness to No. 1 owing to its crossover of 23%. Like No. 2, sample No. 11 experienced a sensitivity drop of 0.31 log E after the running test and showed poor fixation.

Example 3

The photosensitive material samples prepared in Example 1 were exposed to X-rays through a UV rapid screen (maximum emission wavelength 340 nm) manufactured by E. I. duPont and the resultant image was evaluated. There were obtained equivalent results corresponding to the construction of the respective photosensitive material samples. The photo-sensitive material samples within the scope of the invention showed superior photographic performance.

Comparative Example 1

In Example 1, the developing agent in the developer was changed from sodium erythorbate to an equimolar amount of hydroquinone. A sensitivity drop is reported in Table 3 as a sensitivity difference (ΔS) between the start and the end of running processing of 1,000 sheets of the quater-size.

TABLE 3

| Photosensitive material | ΔS |
|---|---|
| No. 1 | −0.12 logE |
| No. 2 | −0.34 logE |
| No. 3 | −0.24 logE |
| No. 4 | −0.26 logE |
| No. 5 | −0.26 logE |

TABLE 3-continued

| Photosensitive material | ΔS |
|---|---|
| No. 6 | −0.22 logE |
| No. 7 | −0.21 logE |
| No. 8 | −0.18 logE |
| No. 9 | −0.15 logE |

It is evident that as compared with the developer containing an ascorbic acid type compound, the developer containing hydroquinone caused a substantial sensitivity drop.

Example 4

In Example 1, the fixing agent in the fixer was changed from sodium thiosulfate to an equimolar amount of ammonium thiosulfate. For all the photosensitive materials, it was found that as compared with the fixer containing sodium thiosulfate, the fixer containing ammonium thiosulfate increased the likelihood of silver sludging during the running process.

Example 5

Following the procedure of photosensitive material No. 1 in Example 1 except that the sensitivity of emulsions was properly adjusted and the exposure and processing procedures of Example 1, photosensitive material samples could be prepared which yielded the same sensitivity, gradation and sharpness as the following image forming system.

The reference image forming system was a combination of a photosensitive material SHRS, SHRG, MIFA, SHRA, SHRHA, SHRL, SHRC, MINP or UMMA, an automatic processor Sepros M, a developer CE-D1, a fixer CE-F1, and screens HGM, HGH, and HR4, all manufactured by Fuji Photo-Film Co., Ltd.

The present invention is successful in reducing the amounts of replenishment and spent solutions, increasing processing stability, eliminating troubles such as silver sludging, and enabling rapid, large quantity processing. The automatic processor used can be reduced in size and installed at any desired location.

Although some preferred embodiments have been described, many modifications and variations may be made thereto in the light of the above teachings. It is therefore to be understood that within the scope of the appended claims, the invention may be practiced otherwise than as specifically described.

I claim:

1. A method for processing a photographic silver halide photosensitive material for medical radiographic imaging after imagewise exposure in an automatic processor with processing solutions including a developer, a fixer, and washing water and/or stabilizer while replenishing the respective processing solutions, said photosensitive material comprising a silver halide emulsion of silver halide grains containing at least 20 mol % of silver chloride, at least 50% of the projected area of all silver halide grains being tabular grains having an aspect ratio of at least 2, said photosensitive material having a silver coverage of less than 1.5 grams and a gelatin coverage of less than 2.1 grams per square meter of one surface thereof and a swelling factor of less than 180%, said developer containing an ascorbic acid type compound as a developing agent and being substantially free of a dihydroxybenzene, and said developer being replenished in an amount of less than 150 ml per square meter of said photosensitive material and said fixer being replenished in an amount of less than 300 ml per square meter of said photosensitive material.

2. The method of claim 1 wherein an overall dry-to-dry processing time is less than 80 seconds, an hourly processing throughput is substantially more than 300 sheets of the quarter-size, a developing tank containing the developer and a fixing tank containing the fixer each have a liquid volume of less than 8.0 liters, a tank for washing water and/or stabilizer includes at least two stages, each stage having a liquid volume of less than 8.0 liters, the overall volume of spent solutions of the developer, the fixer and the washing water and/or stabilizer is less than 450 ml per square meter of said photosensitive material, after processing with the processing solutions, said photosensitive material is dried by means of a heat roller, said photosensitive material is capable of forming an image by combining it with a fluorescent screen having a maximum emission wavelength of longer then 500 nm or shorter than 350 nm, with crossover light being less than 20%, and said fixer contains sodium thiosulfate as a fixing agent.

3. The method of claim 1 wherein continuous processing is possible in the substantial absence of pipes for the spent solutions of the developer and the fixer, pipes for replenishment and waste discharge of the washing water and/or stabilizer, and a stenchful vapor duct.

4. The method of claim 2 wherein the overall processing time is less than 50 seconds.

5. The method of claim 1 wherein in the silver halide emulsion, tabular grains having {100} faces as major faces and an aspect ratio of at least 2 account for at least 50% of the projected area of all silver halide grains.

6. The method of claim 1 wherein in the silver halide emulsion, the silver halide grains contain 50 to 100 mol % of silver chloride.

7. The method of claim 1 wherein said photosensitive material further comprises a solid dispersion of a dye of the following general formula (I):

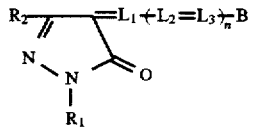

(I)

wherein $R_1$ is selected from the class consisting of a hydrogen atom, alkyl, aryl, and heterocyclic group; $R_2$ is selected from the class consisting of a hydrogen atom, alkyl, aryl, heterocyclic, alkoxycarbonyl, aryloxycarbonyl, carbamoyl, acylamino, ureido, amino, acyl, alkoxy, aryloxy, hydroxy, carboxy, cyano, sulfamoyl, and sulfonamide group; B is a 5- or 6-membered oxygen-containing heterocyclic group or 6-membered nitrogen-containing heterocyclic group; $L_1$ to $L_3$ are methine groups; and letter n is 0 to 2.

8. The method of claim 1 wherein said photosensitive material further comprises a polymer latex produced by polymerizing a difficultly soluble monomer and the polymer latex is added in an amount of 5 to 70% by weight of the weight of a binder in photographic layers.

9. The method of claim 1 wherein in said photosensitive material, the silver coverage is 0.5 to 1.5 grams per square meter of one surface.

10. The method of claim 1 wherein in said photosensitive material, the gelatin coverage is 0.7 to 2.0 grams per square meter of one surface.

11. The method of claim 1 wherein said silver halide emulsion contains $1.0\times10^{-3}$ to $5.0\times10^{-1}$ mol of a polyhydric alcohol per mol of the silver halide.

12. The method of claim 1 wherein said photosensitive material has a swelling factor of 30 to 180%.

13. The method of claim 1 wherein said developer is replenished in an amount of 25 to 150 ml per square meter of said photosensitive material and said fixer is replenished in an amount of 13 to 300 ml per square meter of said photosensitive material.

14. The method of claim 1 wherein the ascorbic acid type compound in said developer is of the following general formula (II):

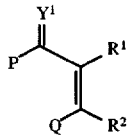

(II)

wherein each of $R^1$ and $R^2$ are independently selected from the class consisting of a hydroxyl, substituted or unsubstituted amino, acylamino, alkylsulfonylamino, arylsulfonylamino, alkoxycarbonylamino, mercapto, and alkylthio group.

15. The method of claim 14 wherein said developer contains 0.01 to 0.8 mol/liter of the ascorbic acid type compound.

16. The method of claim 14 wherein said developer contains 0.1 to 0.4 mol/liter of the ascorbic acid type compound.

17. The method of claim 1 wherein said developer is at pH 8.5 to 10.5.

18. The method of claim 1 wherein said fixer contains 0.1 to 5 mol/liter of a thiosulfate.

19. The method of claim 1 further comprising the step of drying the photosensitive material using a heat roller at a surface temperature of 60 to 120° C.

20. The method of claim 4 wherein the overall processing time is 20 to 50 seconds.

21. The method of claim 2 wherein the hourly processing throughput is 300 to 800 sheets of the quarter-size, and the developing and fixing tanks each have a liquid volume of 4.0 to 8.0 liters.

* * * * *

UNITED STATES PATENT AND TRADEMARK OFFICE

CERTIFICATE OF CORRECTION

PATENT NO. : 5,780,209

DATED : July 14, 1998

INVENTOR(S) : Seiji YAMASHITA

It is certified that error appears in the above-identified patent and that said Letters Patent is hereby corrected as shown below:

On the title page;

In Section [30], kindly delete "Sep. 6, 1996" and insert -- July 9, 1996 --.

In Section [73], kindly delete "Minami-ashigara" and insert -- Kanagawa --.

In Column 66, line 23, kindly delete "then" and insert -- than --.

Signed and Sealed this

Twelfth Day of January, 1999

*Attest:*

*Attesting Officer*

*Acting Commissioner of Patents and Trademarks*